US007614761B2

(12) United States Patent
Tanaka

(10) Patent No.: US 7,614,761 B2
(45) Date of Patent: Nov. 10, 2009

(54) SHOWCASE

(75) Inventor: Tsutomu Tanaka, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 112 days.

(21) Appl. No.: 11/706,283

(22) Filed: Feb. 15, 2007

(65) Prior Publication Data

US 2007/0195518 A1 Aug. 23, 2007

(30) Foreign Application Priority Data

Feb. 22, 2006 (JP) ..... 2006-045309

(51) Int. Cl.
*F21V 33/00* (2006.01)

(52) U.S. Cl. ..... 362/133; 362/92; 362/125; 362/260

(58) Field of Classification Search ..... 362/125, 362/133, 92, 260
See application file for complete search history.

(56) References Cited

U.S. PATENT DOCUMENTS 4,017,130 A * 4/1977 Hanson ..... 312/128
5,471,372 A * 11/1995 Mamelson et al. ..... 362/92

FOREIGN PATENT DOCUMENTS

| | | |
|---|---|---|
| EP | 0 657 708 | 6/1995 |
| JP | 5-69892 | 9/1993 |
| JP | 07 143928 | 6/1995 |
| JP | 7-143928 | 6/1995 |

* cited by examiner

*Primary Examiner*—Stephen F Husar
*Assistant Examiner*—Meghan K Dunwiddie
(74) *Attorney, Agent, or Firm*—Kratz, Quintos & Hanson, LLP

(57) ABSTRACT

An object is to provide a showcase capable of realizing a stable attaching operation of sockets and a replacement operation of an illuminative lamp, the showcase provided with the illuminative lamp having terminals at opposite end portions, respectively, includes a pair of sockets which connect the illuminative lamp to a power source of a main body, each socket includes a housing having an opening in at least a surface on an illuminative lamp side, and a lid member to block the opening of the housing in a state in which the terminals are allowed to enter the housing, the housing has a connecting portion to store a power supply portion internally connected to the terminal, and a holding protrusion moved in a direction disengaging from the illuminative lamp to engage with a lower surface of a shelf, and the lid member is fixed to the lower surface of the shelf by a screw in a state in which the lid member blocks the opening of the housing which holding protrusion is engaged with the lower surface of the shelf.

4 Claims, 16 Drawing Sheets

SHOWCASE

BACKGROUND OF THE INVENTION

The present invention relates to an illuminative lamp disposed to illuminate the inside of a showroom or a part before a showcase. The present invention more particularly relates to a showcase provided with an illuminative lamp having terminals at end portions.

Heretofore, in a showcase installed in a supermarket, a convenience store or the like, an illuminative lamp for illuminating the inside of a showroom, a part before a showcase or the like is disposed in the showroom formed in a main body. The illuminative lamp is positioned and attached to a lower surface of a canopy positioned at a front part of a ceiling surface of the showroom, or a front part of a lower surface of a shelf in a case where a plurality of shelves are arranged. As the illuminative lamp, a fluorescent lamp or the like is generally used. Therefore, a replacement operation is required owing to deterioration with age.

Each illuminative lamp disposed in the showroom is connected to feeder lines connected to a power source disposed in a machine room (see, e.g., Japanese Patent Application Laid-Open No. 7-143928 (Document 1)). Since the illuminative lamp is attached to the front part of the showroom, the feeder lines are drawn and wired to an attachment position of the illuminative lamp, and fixed along the lower surface of the shelf or the ceiling surface. A socket is attached to an end portion of the feeder line. When a terminal disposed at an end portion of the illuminative lamp is attached to the socket, the illuminative lamp is electrically connected to the feeder lines, and electrically connected to the power source via the feeder lines.

In this case, in consideration of an operability in attaching or detaching the illuminative lamp to or from the sockets connected to the feeder lines, the feeder line in the vicinity of the socket is fixed to the vicinity of an attachment place of the illuminative lamp in a state in which predetermined looseness is kept in the feeder line. Therefore, in a state in which the illuminative lamp is attached, there has been a problem that, when the feeder lines sag downward from the lower surface of the shelf or the ceiling surface, the feeder lines are exposed on the front surface of the showroom, and an appearance is unfavorable.

Moreover, the illuminative lamp electrically connected to the feeder lines via the sockets is fixed by holding the lamp with clips or the like fixed to the lower surface of the shelf or the ceiling surface of the showroom. Therefore, since the long illuminative lamp attached to the showcase so as to range from side to side needs to be detached from or attached to a plurality of clips attached in a longitudinal direction, or detached from or attached to each socket during the replacement operation, there is a problem that the operation is troublesome.

To solve the problem, an attaching device of a fluorescent lamp is developed as disclosed in, for example, Japanese Utility Model Application Laid-Open No. 5-69892 (Document 2) in order to simplify the above-described replacement operation of the illuminative lamp and prevent exposure of the feeder lines. This attaching device of the fluorescent lamp is constituted of a socket main body fixed to a lower surface of a shelf, and fluorescent lamp holders fixedly attached to the socket main body. The fluorescent lamp holders are attached to opposite ends of the fluorescent lamp provided with terminal pins for receiving power. When the fluorescent lamp holders are attached to the socket main body, the feeder lines are not loosened or exposed from the shelf lower surface, and the fluorescent lamp is attached to the shelf lower surface by only engagement of the fluorescent lamp holders with the socket main body.

However, in the above-described socket constitution disclosed in Document 2, the socket main body to be attached to the shelf lower surface is positioned at an attachment position by protrusions protruding from an upper surface of a horizontal portion, and attached to the shelf lower surface by screws. At this time, a fixing direction of each screw is parallel to an attaching/detaching direction of the fluorescent lamp. That is, the fluorescent lamp is attached or detached in a direction vertical to the shelf lower surface, whereas a fixing direction of the screw is similarly a direction vertical to the shelf lower surface.

Therefore, when the attaching/detaching operation of the fluorescent lamp is repeatedly performed, the screws to fix the socket main body loosen, and the socket main body might fall from the shelf lower surface. Especially, when the fluorescent lamp is removed, the fluorescent lamp is extracted downwards together with the fluorescent lamp holders. In consequence, the engagement between the fluorescent lamp holders and the socket main body is released to remove the fluorescent lamp. Therefore, to remove the fluorescent lamp, when the lamp is extracted right downwards, an only force to release the engagement between the fluorescent lamp holders and the socket main body is applied to the socket main body. Therefore, the screws which fix the socket main body to the shelf lower surface easily loosen, and there has been a problem that the socket main body disadvantageously falls during the removing operation.

SUMMARY OF THE INVENTION

Therefore, the present invention has been developed to solve a conventional technical problem, and an object thereof is to provide a showcase in which an attaching operation of sockets and a replacement operation of an illuminative lamp can stably be realized.

A first invention is directed to a showcase provided with an illuminative lamp having terminals at opposite end portions, respectively, the showcase comprising: a pair of sockets which connect the illuminative lamp to a power source of a main body, each socket including a housing having an opening in at least a surface on an illuminative lamp side, and a lid member to block the opening of the housing in a state in which the terminals are allowed to enter the housing, the housing having a connecting portion to store a power supply portion internally connected to the terminal, and an engagement portion moved in a direction disengaging from the illuminative lamp to engage with the main body, the lid member being fixed to the main body by a fixing member in a state in which the lid member blocks the opening of the housing which engagement portion is engaged with the main body.

The showcase of a second invention is characterized in that in the above invention, the housing has an auxiliary engagement portion to engage with the main body in a position on a side opposite to the engagement portion via the connecting portion.

The showcase of a third invention is characterized in that in the above invention, the auxiliary engagement portion is moved in a direction which meets a longitudinal direction of the illuminative lamp to engage with the main body, and has a wall in a direction crossing the movement direction at right angles on a surface on a side opposite to the illuminative lamp.

The showcase of a fourth invention is characterized in that in the second or third invention, the socket is constituted of a main body side socket member including the housing and the lid member, and an illuminative lamp side socket member attached to the illuminative lamp and detachably attached to the main body side socket member, the connecting portion of the housing has an inserting portion capable of passing the terminal in the surface crossing the opening at right angles, and the illuminative lamp side socket member is attached to the main body side socket member from a direction of the inserting portion so that the terminal passes through the inserting portion and is connected to the power supply portion.

According to the first invention, the showcase provided with the illuminative lamp having the terminals at the opposite end portions, respectively, includes the pair of sockets which connect the illuminative lamp to the power source of the main body. Each socket includes the housing having the opening in at least the surface on the illuminative lamp side, and the lid member to block the opening of the housing in the state in which the terminals are allowed to enter the housing. The housing has the connecting portion to store the power supply portion internally connected to the terminal, and the engagement portion moved in the direction disengaging from the illuminative lamp to engage with the main body. The lid member being fixed to the main body by a fixing member in a state in which the lid member blocks the opening of the housing which engagement portion is engaged with the main body. Therefore, the engagement of the engagement portion of the housing is securely maintained.

Therefore, when the illuminative lamp is attached to each socket, the socket undergoes an urging force directed in the longitudinal direction of the illuminative lamp. The direction is an engagement direction of the engagement portion and a direction in which the blocking by the lid member is maintained. Therefore, it is possible to satisfactorily perform the engaging of the housing of the socket, the fixing of the lid member of the socket and the maintaining of bonding between the housing and the lid member.

Therefore, in a state in which the engagement portion of the housing is engaged with the main body, the lid member is fixed to the main body by the fixing member in a position where release of the engagement of the engagement portion is prohibited. Therefore, even in a case where a force is applied in such a direction as to disengage the illuminative lamp from the main body, it is possible to avoid a disadvantage that the housing and the lid member are separated. In consequence, the attaching of the sockets and the replacing of the illuminative lamp can stably be realized.

According to the second invention, in the above invention, the housing has the auxiliary engagement portion to engage with the main body in the position on the side opposite to the engagement portion via the connecting portion. Therefore, it is possible to engage the housing constituting the socket with the main body by the engagement portion and the auxiliary engagement portion via the connecting portion, and an attaching strength of the housing can be improved.

In consequence, to perform the replacement operation of the illuminative lamp, even in a case where the force is applied in such a direction as to disengage the illuminative lamp from the main body to apply a force to the socket itself in such a direction as to disengage the socket from the main body, a disadvantage that the socket itself disengages from the main body can be avoided by the engagement between the socket and the main body realized by the engagement portion and the auxiliary engagement portion formed in the housing as described above.

Moreover, according to the third invention, in the above invention, the auxiliary engagement portion is moved in the direction which meets the longitudinal direction of the illuminative lamp to engage with the main body, and has the wall in the direction crossing the movement direction at right angles on the surface on the side opposite to the illuminative lamp. Therefore, when a wall surface is disposed externally in the longitudinal direction of the illuminative lamp, that is, externally from the socket, a wall of the blocked surface of the auxiliary engagement portion abuts on the wall surface. In consequence, it is possible to suppress a disadvantage that the socket itself falls or an attachment position deviates.

In consequence, when the wall formed at the auxiliary engagement portion abuts on the wall surface positioned externally from the socket, it is possible to undergo the urging force directed in the longitudinal direction of the illuminative lamp, and an attaching strength of the socket can further be improved.

According to the fourth invention, in the second or third invention, the socket is constituted of the main body side socket member including the housing and the lid member, and the illuminative lamp side socket member attached to the illuminative lamp and detachably attached to the main body side socket member, the connecting portion of the housing has the inserting portion capable of passing the terminal in the surface crossing the opening at right angles, and the illuminative lamp side socket member is attached to the main body side socket member from the direction of the inserting portion so that the terminal passes through the inserting portion and is connected to the power supply portion. Therefore, in a state in which the illuminative lamp side socket member is attached to the terminal of the illuminative lamp, when the illuminative lamp side socket member is attached to the main body side socket member, the terminal of the illuminative lamp can securely electrically be connected to the power supply portion of the main body side socket member.

In consequence, even in a case where a force is applied by a weight of the illuminative lamp in a direction in which the terminal of the illuminative lamp attached to the main body by the socket disengages from the power supply portion of the socket, when the terminal of the illuminative lamp is attached to the illuminative lamp side socket member and the main body side socket member, the terminal is securely connected to the power supply portion stored in the main body side socket member. Therefore, it is possible to avoid beforehand incomplete lighting due to contact defect and burnout of the terminal and the sockets due to an abnormal temperature rise.

Moreover, the illuminative lamp can easily be attached to the main body as compared with a conventional constitution in which the illuminative lamp is held by clips.

Furthermore, an attaching/detaching direction of the illuminative lamp side socket member crosses, at right angles, a direction in which the engagement portion and the auxiliary engagement portion engage with the main body. Therefore, the attaching strength of the socket can be improved against a force during the attaching/detaching of the illuminative lamp. In consequence, since the sockets can stably be attached to the main body, the attaching/detaching operation of the illuminative lamp can stably be performed, and an operability can be improved.

DETAILED DESCRIPTION OF THE PREFERRED EMBODIMENT

Figure 1:
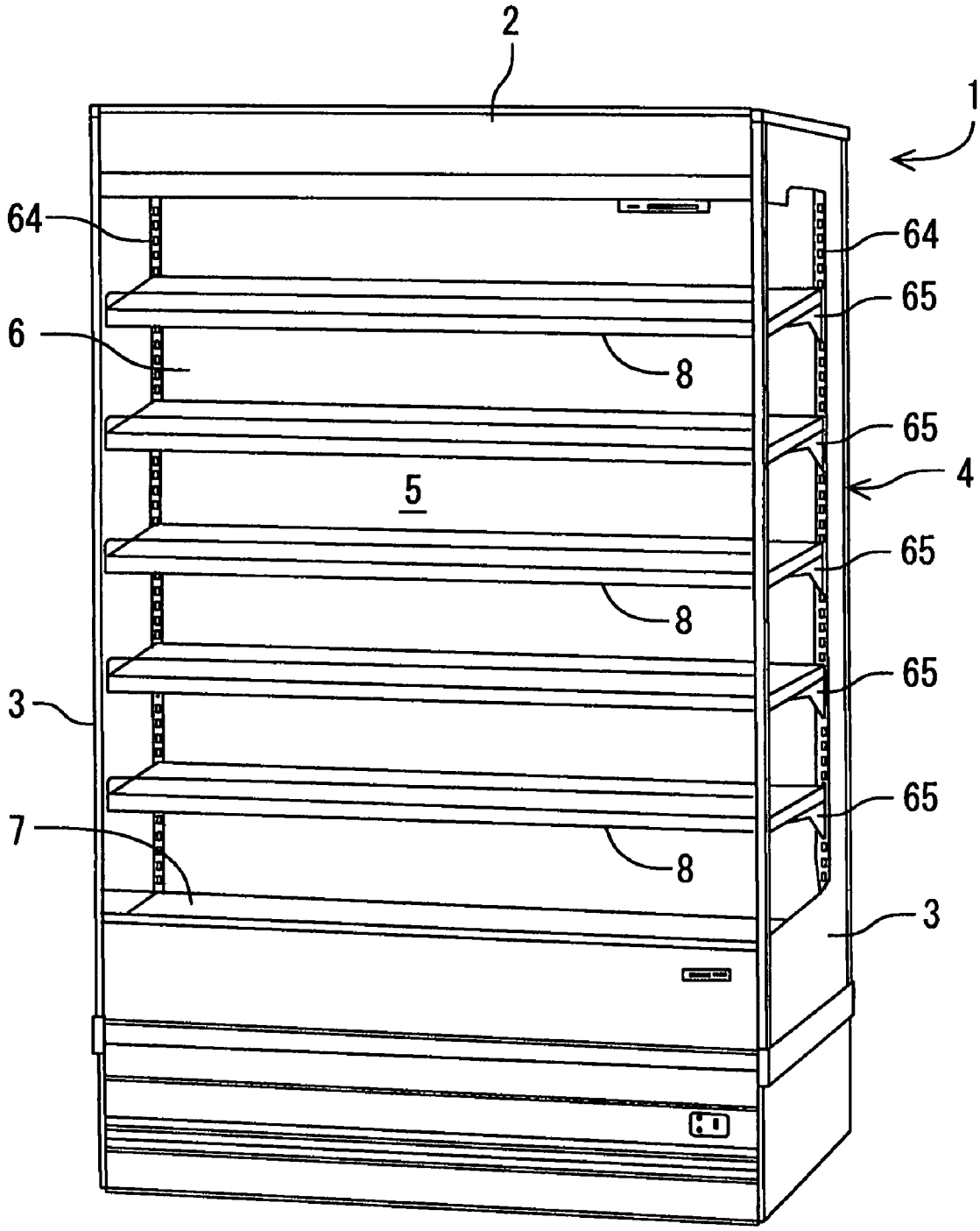
FIG. 1 is a perspective view of a low-temperature showcase.
Figure 2:
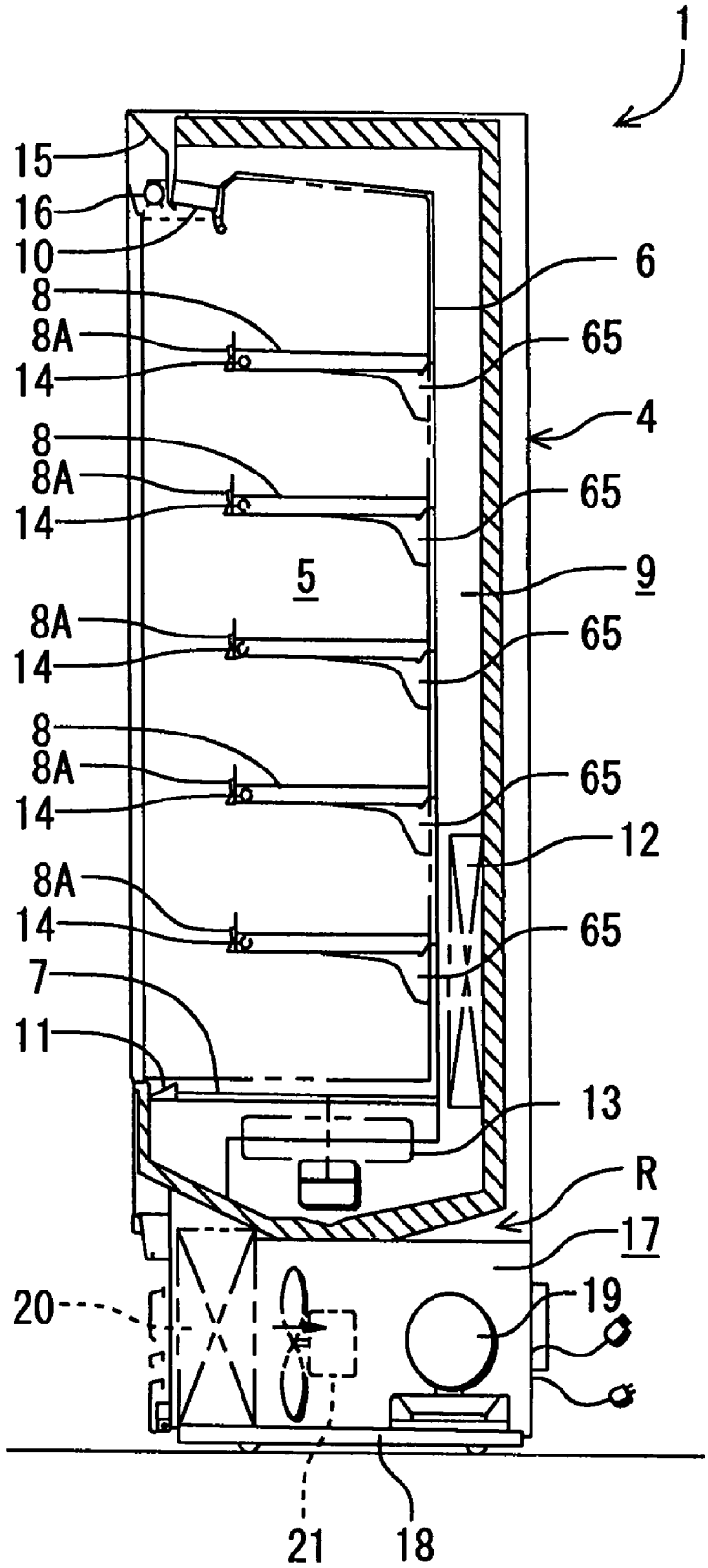
FIG. 2 is a schematic vertical side view of the low-temperature showcase of FIG. 1.

An embodiment to which the present invention is applied will hereinafter be described with reference to the drawings. FIG. 1 is a perspective view of a low-temperature showcase 1 as an embodiment of a showcase of the present invention, and FIG. 2 is a schematic vertical side view of the low-temperature showcase 1. In the drawings, the low-temperature showcase 1 is installed in a store such as a supermarket or a convenience store. Side plates 3, 3 are attached to opposite sides of an insulation wall 2 substantially having a U-shaped section to constitute a main body 4. On an inner side of this insulation wall 2, a partition plate 6 and a bottom plate 7 are attached at an interval. On the inner side of these components, a showroom 5 having an opened front surface is constituted, and a series of ducts 9 are arranged between these components and the insulation wall 2.

Moreover, this duct 9 communicates with a discharge port 10 which opens at an opening upper edge of the showroom 5 and a suction port 11 which opens at an opening lower edge. Furthermore, a cooler 12 included in a cooling device R is vertically disposed in the duct 9 on a rear surface, and a blower 13 is disposed in the duct 9 under the bottom plate 7. In the showroom 5, a plurality of shelves 8 . . . are vertically arranged as described later in detail.

On the other hand, a machine room 17 is formed under the insulation wall 2, and a unit base 18 is disposed in the machine room 17. A compressor 19, a condenser 20 and a blower 21 for the condenser included in the cooling device R are installed on the unit base 18, and arranged in the machine room 17.

According to the above constitution, when the blower 13 is operated, cool air subjected to heat exchange between air and the cooler 12 is raised in the duct 9, and discharged into the showroom 5 from the discharge port 10. Moreover, the cool air sucked from the suction port 11 is heated again by the blower 13, and the cool air is circulated through the showroom 5 to cool the showroom 5 at a predetermined temperature.

Figure 3:
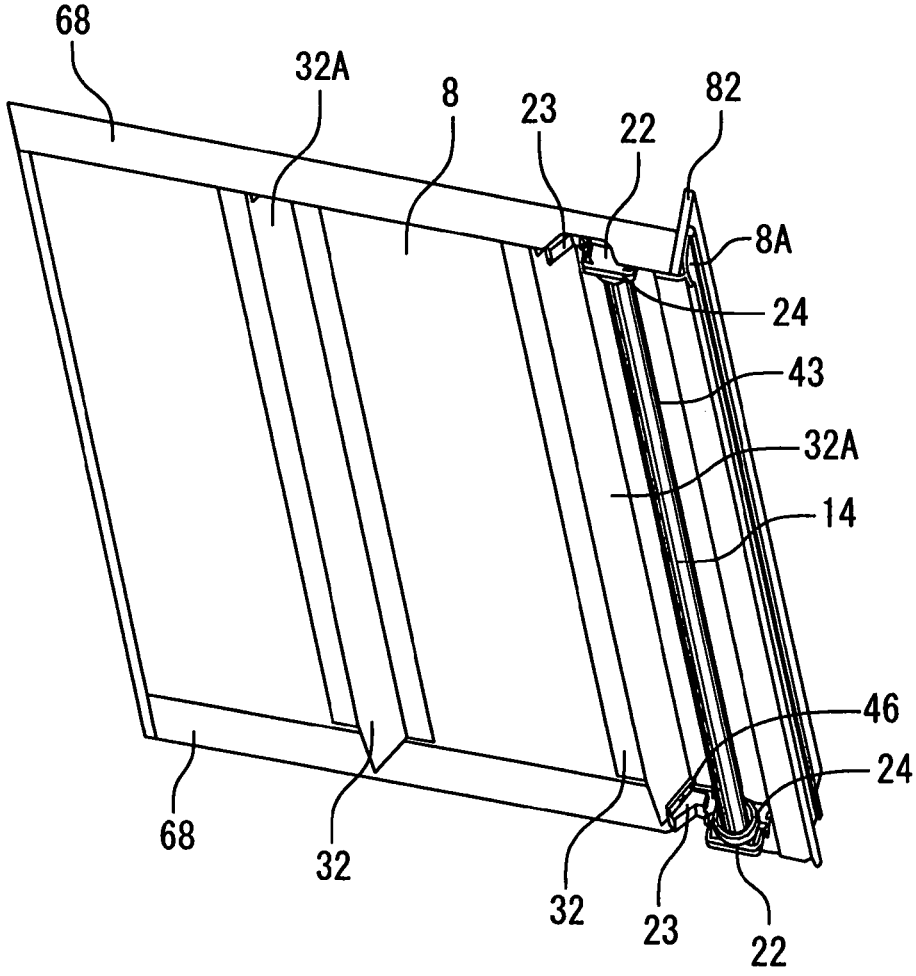
FIG. 3 is a perspective view of a lower surface of a shelf to which sockets and an illuminative lamp are attached.
Figure 4:
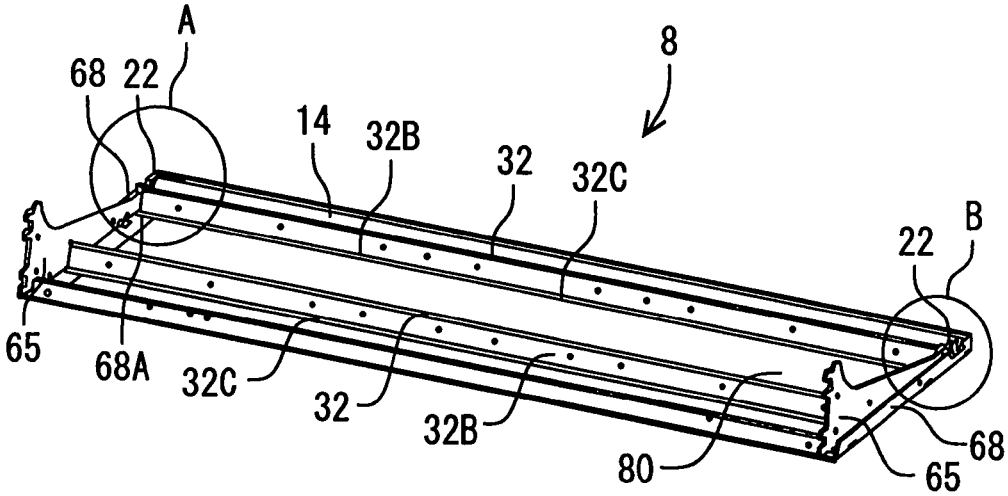
FIG. 4 is a rear perspective view of the lower surface of the shelf.
Figure 5:
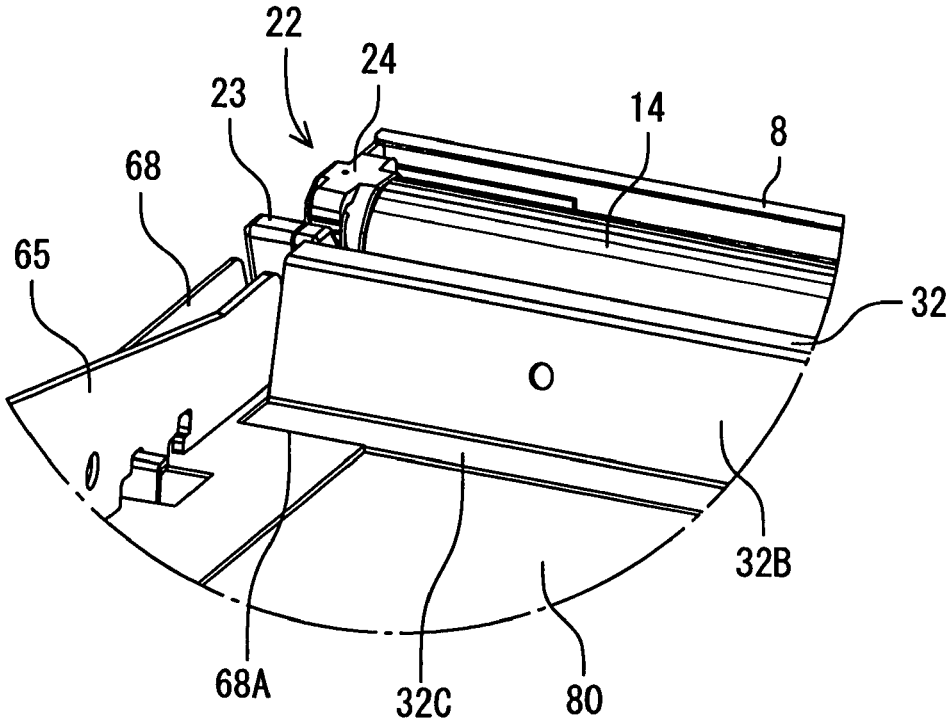
FIG. 5 is a partially enlarged view of a circle A of FIG. 4.
Figure 6:
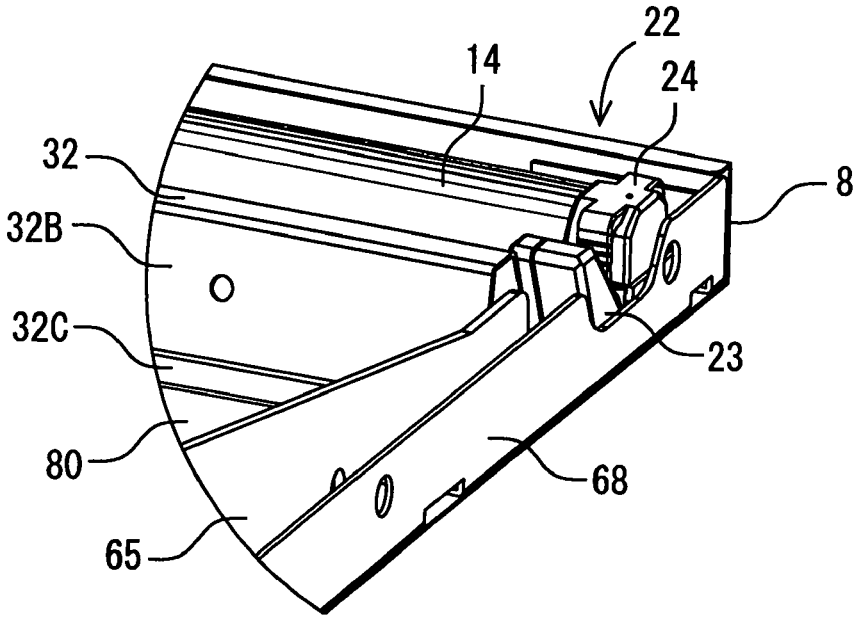
FIG. 6 is a partially enlarged view of a circle B of FIG. 4.
Figure 7:
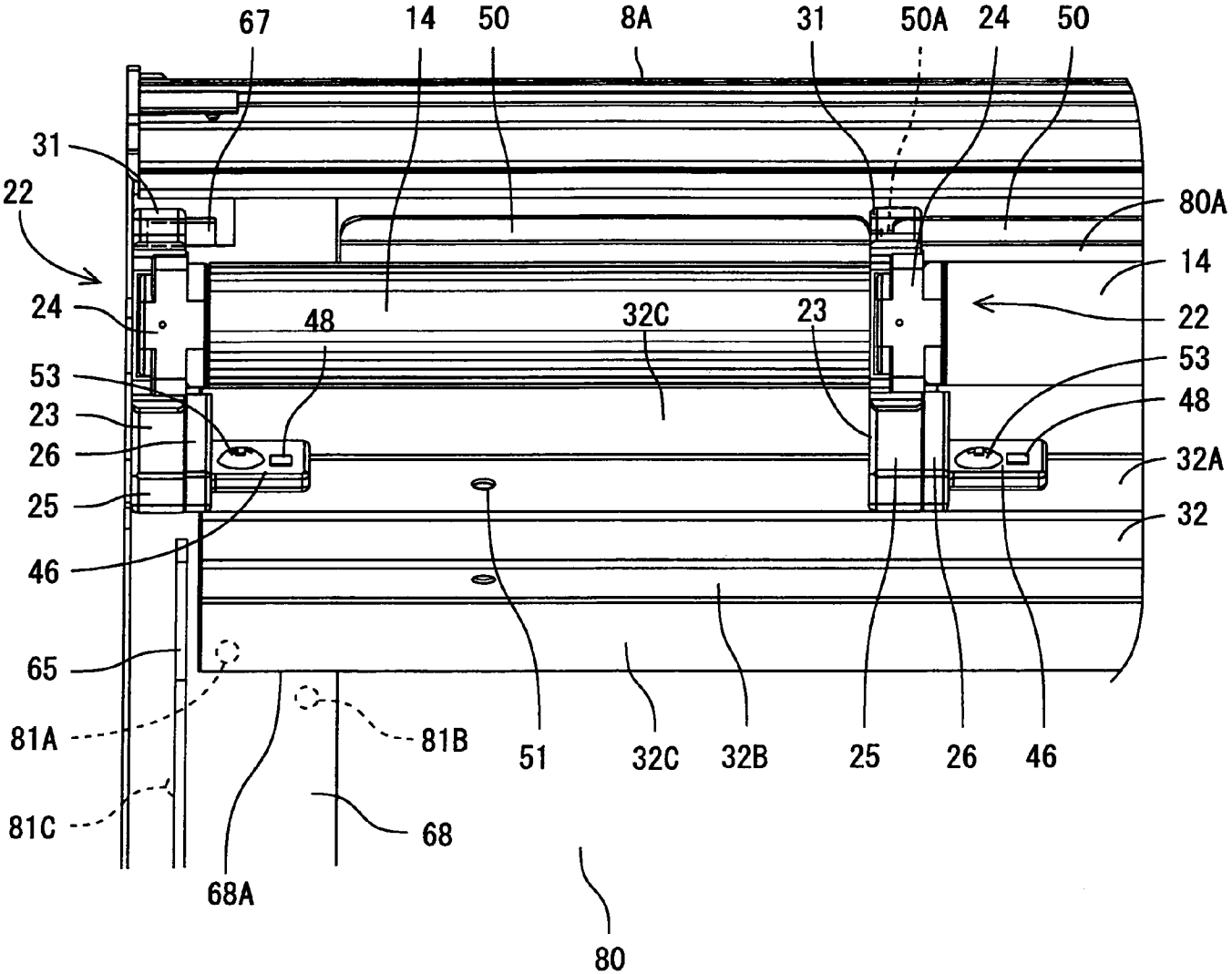
FIG. 7 is a partially enlarged plan view of the shelf lower surface.
Figure 8:
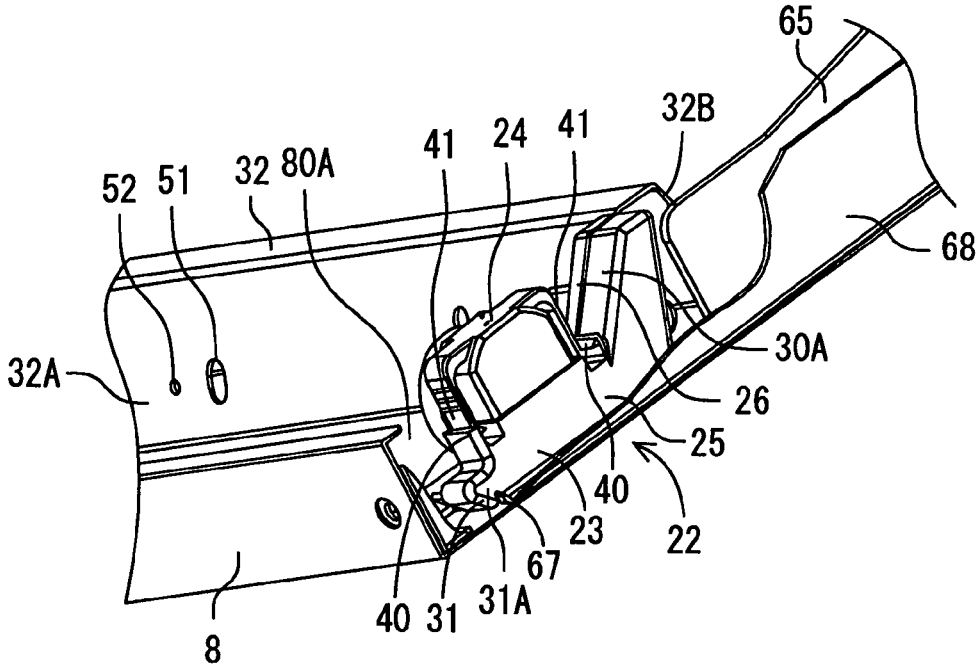
FIG. 8 is an enlarged perspective view showing that the socket is attached to a shelf end portion as viewed from below.
Figure 9:
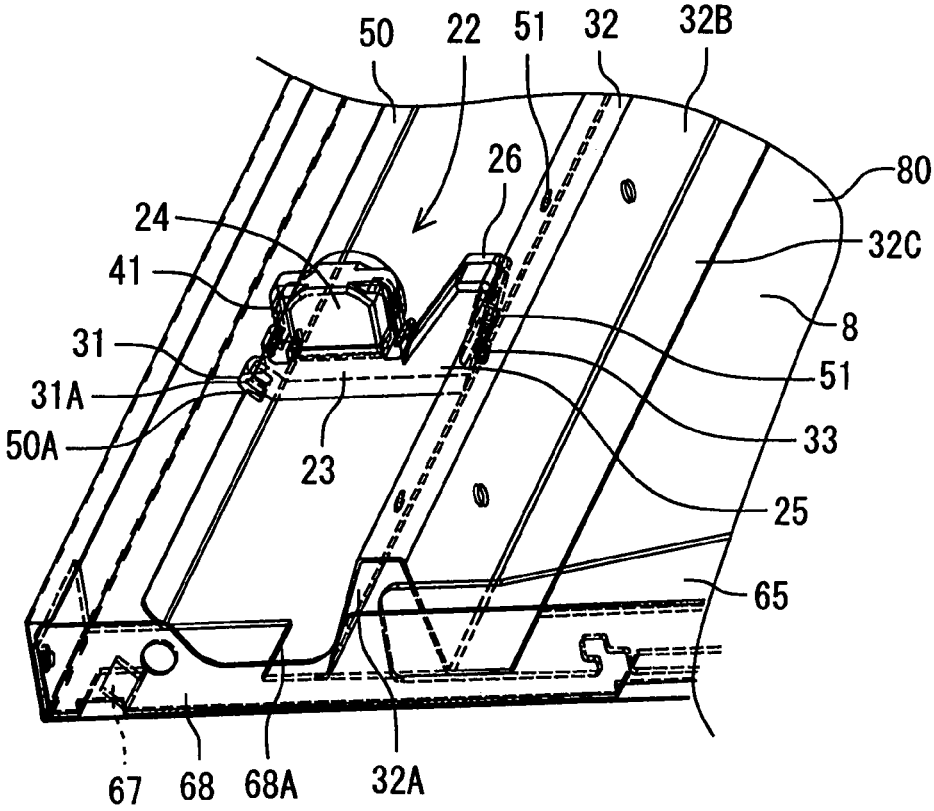
FIG. 9 is a partially perspective view of the shelf lower surface.

Next, the shelf 8 will be described in detail with reference to FIGS. 3 to 8. FIG. 3 is a perspective view of a lower surface of the shelf 8, FIG. 4 is a rear perspective view of the lower surface of the shelf 8, FIG. 5 is a partially enlarged view of a circle A of FIG. 4, FIG. 6 is a partially enlarged view of a circle B of FIG. 4, FIG. 7 is a partially enlarged plan view of the lower surface of the shelf 8, FIG. 8 is an enlarged perspective view showing that a socket 22 is attached to a shelf end portion as viewed from below, and FIG. 9 is a partially perspective view of the lower surface of the shelf 8. It is to be noted that to illustrate an attached state of the socket 22, FIG. 7 shows that the sockets 22 and illuminative lamps 14 are attached on an end portion side and an inner side, respectively.

The shelf 8 is held by supports 64 arranged in the showroom 5 via brackets 65, 65 attached to the left and the right. This shelf 8 includes a shelf plate 80 constituted of a steel plate material; shelf side plates 68, 68 positioned on opposite sides of the shelf plate 80 and attached to the lower surface of the shelf plate; and reinforcement plates 32, 32 attached to the lower surface of the shelf plate 80 from side to side.

A front end and a rear end of the shelf plate 80 are bent downwards substantially at right angles to form a front wall and a rear wall. The shelf side plate 68 is bent so as to substantially have an L-shaped section. An upper surface of the shelf side plate 68 is allowed to abut on the lower surface of the shelf plate 80 so that a side surface of the shelf plate is the same plane as that of a side edge of the shelf side plate, and the shelf side plate is fixed by spot welding.

Moreover, the reinforcement plates 32 are reinforcement members of the shelf side plate 68 positioned in two places including a shelf lower front portion and a shelf lower rear portion. This reinforcement plate 32 is a plate-like member bent so as to substantially have a trapezoidal section in which an upper side is longer than a lower side. A front wall 32A of the reinforcement plate 32 is an inclined surface which forms an obtuse angle with the lower surface of the shelf plate 80. Moreover, a rear wall 32B is constituted as an inclined surface which is substantially vertical to the lower surface of the shelf plate 80 or which forms a slightly obtuse angle with the lower surface.

Furthermore, a front upper end and a rear upper end of this reinforcement plate 32 are abutment surfaces 32C bent outwards along the lower surface of the shelf plate 80, and the abutment surfaces 32C are fixed by the spot welding. It is to be noted that opposite ends of this reinforcement plate 32 are arranged at predetermined intervals from the shelf side plates 68. As shown in FIG. 7, a space where the bracket 65 is stored is formed between the reinforcement plate 32 and the shelf side plate 68.

In the present embodiment, cutouts 68A are formed at positions corresponding to attachment positions of the reinforcement plates 32, 32 in the upper surfaces of the shelf side plates 68 so as to avoid the reinforcement plates 32, 32 from being superimposed on the upper surfaces. Therefore, end portions of the reinforcement plates 32, 32 are fixed so as to be surrounded with the cutouts 68A formed in the upper surfaces of the shelf side plates 68.

At this time, as shown in FIG. 7, the spot welding of the reinforcement plates 32 and the shelf side plates 68 to the shelf plate 80 is performed on at least three places including a reinforcement member fixing spot 81A of the shelf plate 80 to an end portion of the abutment surface 32C of the reinforcement plate 32; a shelf side plate fixing spot 81B of the shelf plate 80 to an abutment surface of the shelf side plate 68, the spot being positioned on an inner side from the reinforcement member fixing spot 81A, that is, at an inner side end portion of the upper surface of the shelf side plate 68; and a shelf side plate fixing spot 81C of the shelf plate 80 to the abutment surface of the shelf side plate 68, the spot being positioned on an outer side from the reinforcement member fixing spot 81A, that is, at an outer side end portion of the upper surface of the shelf side plate 68. At this time, it is assumed that the shelf side plate fixing spot 81B is positioned at a corner portion formed by the cutout 68A of the shelf side plate 68, and the reinforcement member fixing spot 81A and the shelf side plate fixing spots 81B, 81C form a triangle.

Here, when commodities are displayed to apply a load to the upper surface of the shelf plate 80, the shelf plate 80 itself is deformed, and a force is sometimes applied in such a direction as to peel the reinforcement plate 32 and the shelf side plate 68. In this case, the fixing spots 81A, 81B and 81C to weld the abutment surfaces form the triangle. Therefore, even if the force is applied in such a direction as to peel one place, the other two places are subjected to the spot welding. Therefore, according to functions of these fixing spots, a force in such a direction as to abut on the shelf plate 80 is applied to the place where the force is applied in the peeling direction. Therefore, it is possible to suppress a disadvantage that the reinforcement plate 32 and the shelf side plate 68 peel from the shelf plate 80 even during the spot welding. Therefore, the commodities can stably be displayed on the upper surface of the shelf 8.

Moreover, the reinforcement plate 32 disposed on the shelf 8 is constituted so as to have the substantially trapezoidal section as described above. Therefore, even when a thickness dimension of the shelf 8 itself is reduced, a predetermined strength can be maintained. Even when the commodities are mounted on the upper surface of the shelf 8, the commodities can stably be held.

On the other hand, the lower surface of the shelf 8 is provided with a downwardly protruding attachment piece 50 positioned on a front side of the reinforcement plate 32 and extending from side to side. This attachment piece 50 is constituted of a steel plate material, and inclined forwards and downwards at a predetermined angle. Moreover, this attachment piece 50 is provided with a cutout 50A as shown in FIG. 8, and a plurality of cutouts 50A are formed along the longitudinal direction. In consequence, on the lower surface of the shelf 8, the front wall 32A (a rear reflective plate) of the reinforcement plate 32, the attachment piece 50 (a front reflective plate) and a lower surface (a top reflective plate) 80A of the shelf 8 positioned between the front wall and the attachment piece constitute a series of reflective plates.

It is to be noted that in the present embodiment, any attachment piece 50 is not formed at opposite side ends. As shown in FIG. 9, in a position similar to that of the attachment piece 50, an end portion attaching piece 67 is formed by cutting downwards a part of the shelf plate constituting the shelf 8 at an angle similar to that of the attachment piece 50.

Moreover, an upwardly protruding front plate 82 constituted of a transparent plate material is attached to a front wall of the shelf 8. A price rail 8A which fixes the front plate 82 to the shelf 8 and which is capable of holding a price card on a front surface is positioned on a front surface of the front plate 82 and attached to the front wall of the shelf 8. A lower end of this price rail 8A is extended rearward so as to surround a lower surface of the front plate 82 and a lower surface of the front wall of the shelf plate 8, and is detachably attached to the shelf plate 80. In the present embodiment, the price rail 8A is extended slightly below a lower end of the shelf 8. In consequence, there is an effect that the shelf 8 itself seems to be thin, when the shelf 8 is viewed from the front. Therefore, the whole showcase 1 is aesthetically improved.

Furthermore, the illuminative lamp 14 is detachably attached to the lower surface of the shelf 8 via the sockets 22 described later in detail so as to illuminate the commodities on the shelf 8 disposed under the lamp or a front part of the showroom 5.

In addition, a canopy 15 is positioned in front of the discharge port 10 and disposed at an upper edge of an opening in a front surface of the insulation wall 2. An illuminative lamp 16 is detachably attached to a lower portion of the canopy 15 via the socket 22 so as to illuminate the inside and periphery of the showroom 5 from above. It is to be noted that each of the illuminative lamps 14, 16 includes terminals for receiving power at an end portion, can be lit by electricity supplied from a power supply section, and is, for example, a fluorescent lamp, an LED or the like. In the present embodiment, a so-called T5 tube of a fine tube type is used in which a distance between the terminals is about 5 mm.

Figure 10:
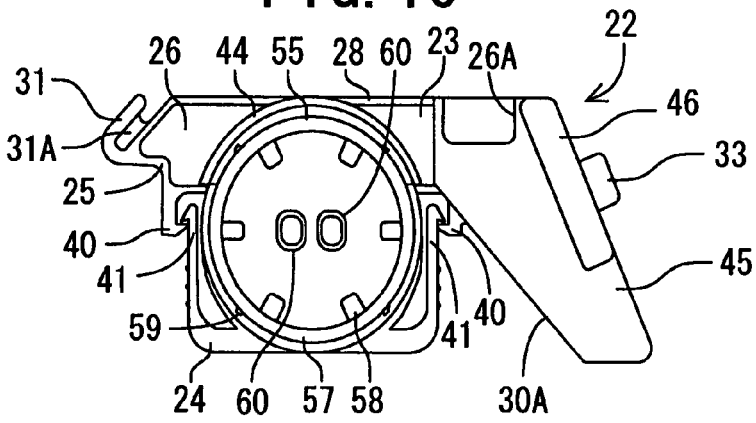
FIG. 10 is a side view of the socket attached to one side of a showroom.
Figure 11:
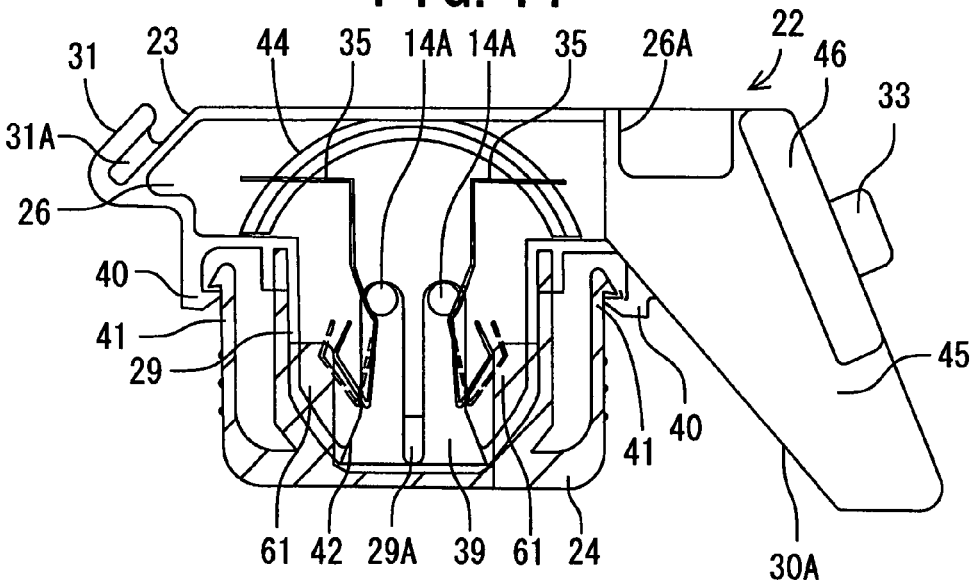
FIG. 11 is a partially see-through sectional view of the socket of FIG. 10.
Figure 12:
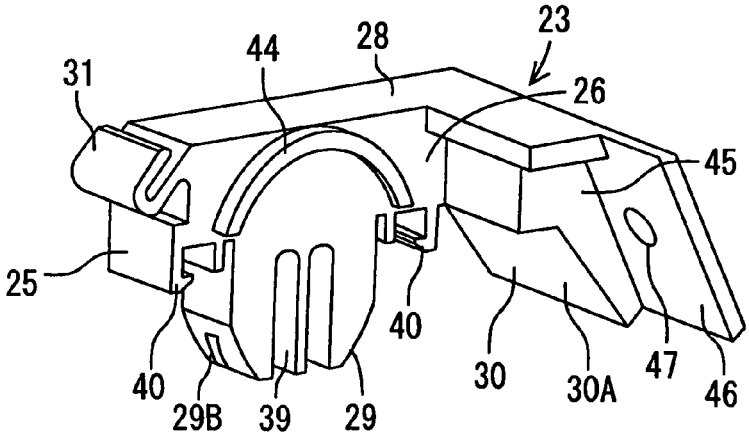
FIG. 12 is a perspective view of a main body side socket member.
Figure 13:
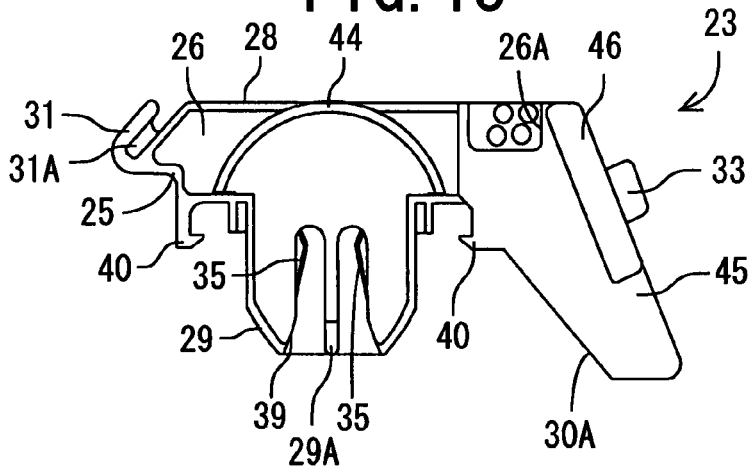
FIG. 13 is a side view of the main body side socket member.
Figure 14:
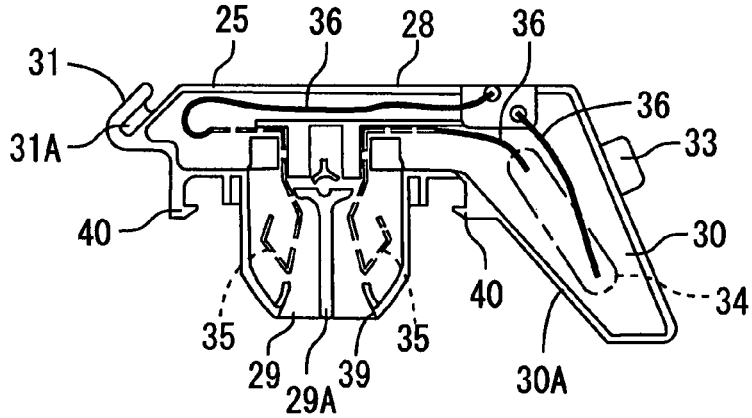
FIG. 14 is a side view of a housing of the main body side socket member.
Figure 15:
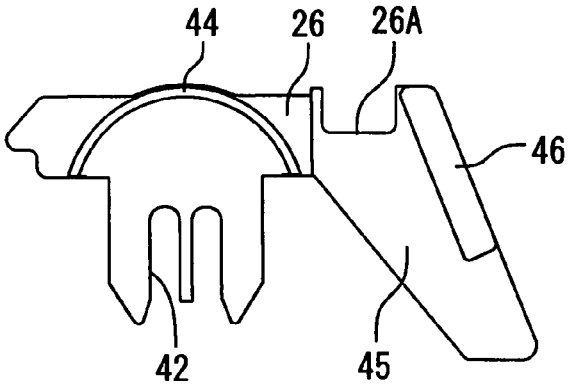
FIG. 15 is a side view of a lid member of the main body side socket member.
Figure 16:
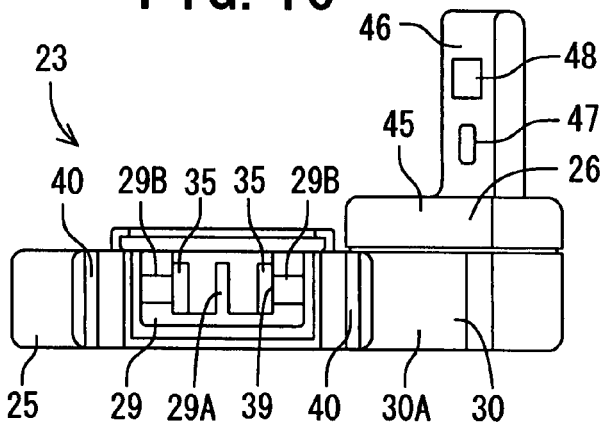
FIG. 16 is a plan view of FIG. 13 viewed from below.
Figure 17:
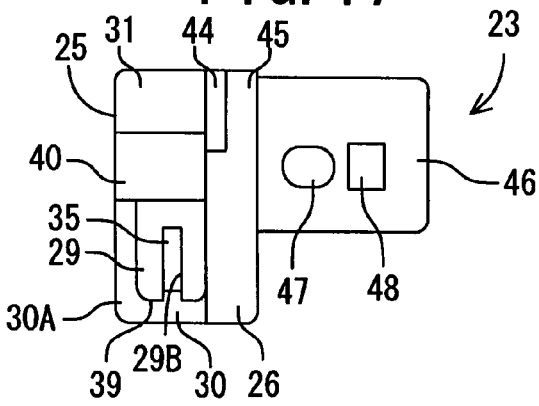
FIG. 17 is a front view of the main body side socket member.
Figure 18:
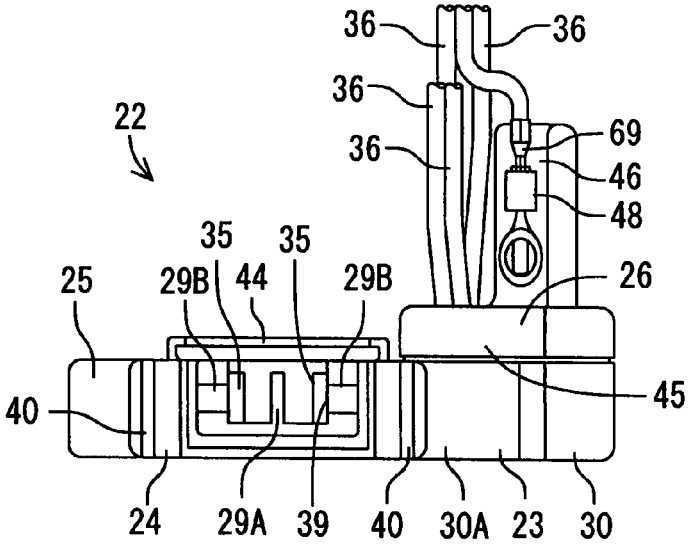
FIG. 18 is a diagram showing that a feeder line is attached to FIG. 16.
Figure 19:
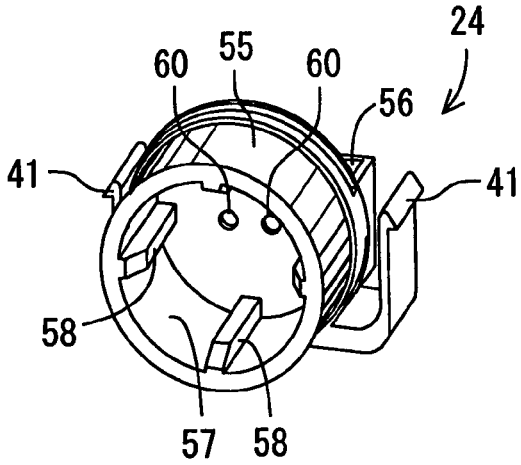
FIG. 19 is a perspective view of an illuminative lamp side socket member.
Figure 20:
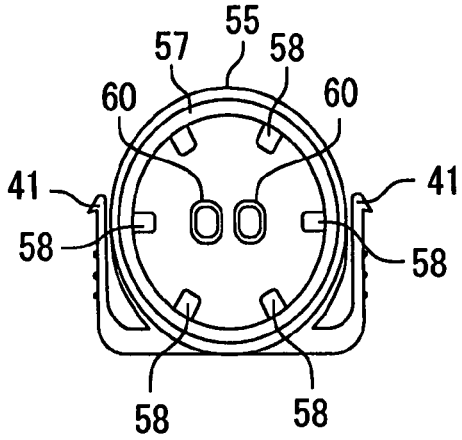
FIG. 20 is a side view of the illuminative lamp side socket member.
Figure 21:
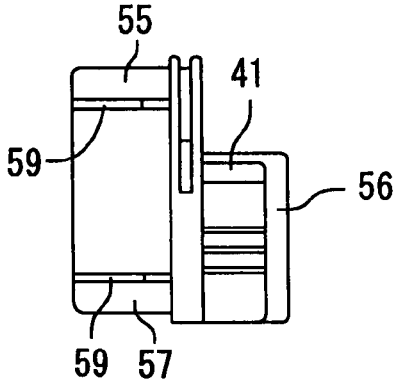
FIG. 21 is a diagram of FIG. 20 viewed from the right.
Figure 22:
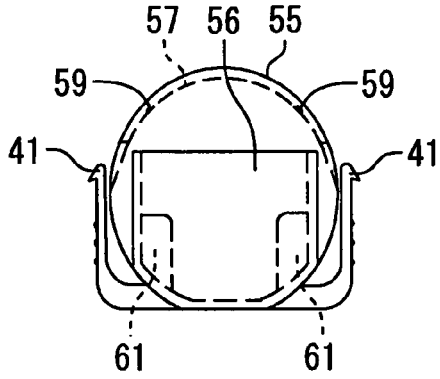
FIG. 22 is a diagram of FIG. 20 viewed from the backside.
Figure 23:
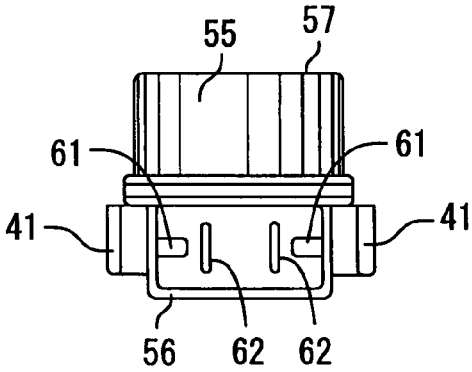
FIG. 23 is a diagram of FIG. 20 viewed from below.
Figure 24:
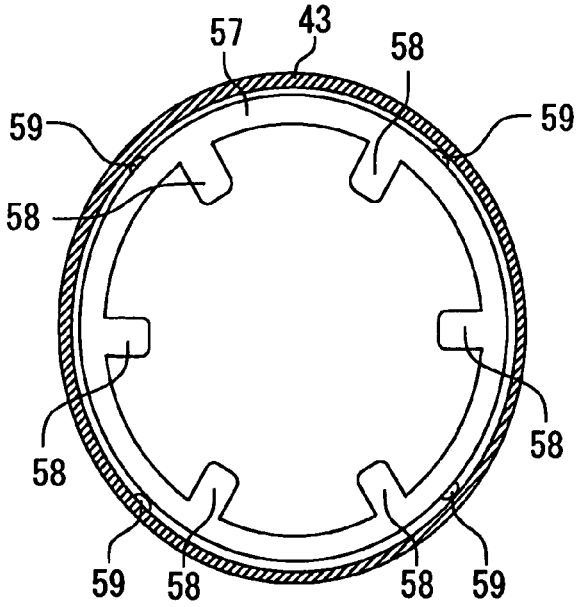
FIG. 24 is an enlarged sectional view of a cover portion.

Next, a structure of each socket 22 will be described with reference to FIGS. 10 to 24. FIG. 10 is a side view of the socket 22 attached to one side of the showroom 4; FIG. 11 is a partially see-through sectional view of the socket 22 of FIG. 10; FIG. 12 is a perspective view of a main body side socket member 23; FIG. 13 is a side view of the main body side socket member 23; FIG. 14 is a side view of a housing 25 of the main body side socket member 23; FIG. 15 is a side view of a lid member 26 of the main body side socket member 23; FIG. 16 is a plan view of FIG. 13 viewed from below; FIG. 17 is a front view of the main body side socket member 23; FIG. 18 is a diagram showing that a feeder line 36 is attached to FIG. 16; FIG. 19 is a perspective view of an illuminative lamp side socket member 24; FIG. 20 is a side view of the illuminative lamp side socket member 24; FIG. 21 is a diagram of FIG. 20 viewed from the right; FIG. 22 is a diagram of FIG. 20 viewed from the backside; FIG. 23 is a diagram of FIG. 20 viewed from below; and FIG. 24 is an enlarged sectional view of a cover portion 57.

In the present embodiment, the sockets 22 fix the illuminative lamp 14 having terminals 14A for receiving the power at end portions are detachably attached to a main body side of the showcase 1, that is, the lower surface of the shelf 8 in the present embodiment. Each socket 22 is constituted of the main body side socket member 23 and the illuminative lamp side socket member 24.

The main body side socket member 23 is constituted of the housing 25 having an opened surface on an illuminative lamp 14 side, and the lid member 26 which blocks the opening in the housing 25. In the housing 25, a main body side attachment surface 28 which abuts on and is attached to the lower surface of the shelf 8, a connecting portion 29 protruding downwards from the main body side attachment surface 28 and a capacitor storage portion 30 formed at a rear end of the main body side attachment surface 28 are integrally molded of a hard synthetic resin. The connecting portion 29 communicates with the capacitor storage portion 30. Moreover, the surfaces of the portions open toward the inside of the showroom 5, that is, the illuminative lamp 14 side.

Moreover, a capacitor 34 is stored in the only capacitor storage portion 30 of one socket 22 of the sockets 22 attached to the opposite ends of the illuminative lamp 14.

Figure 26:
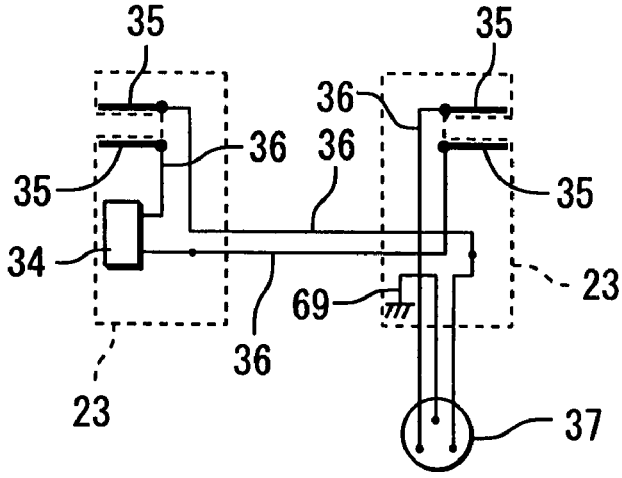
FIG. 26 is an electric wiring line diagram of FIG. 25.

The connecting portion 29 formed in the housing 25 is provided with a partition wall 29A which vertically divides the inside of the housing so as to separately store two hanging power supply contact pieces (power supply portions) 35, 35. Upper ends of these power supply contact pieces 35, 35 are connected to the feeder lines 36. FIG. 26 shows a connection relation between the feeder lines 36 of the power supply contact pieces 35, 35. That is, in the socket 22 in which the capacitor 34 is stored in the housing 25, one of the feeder lines 36 is connected to the capacitor 34. The other feeder line 36 attached to the lid member 26 is drawn outwards, and connected to a power source 37 disposed in the machine room 17 of the showcase 1. In the socket 22 in which the capacitor 34 is not stored in the housing 25, both of the feeder lines 36 attached to the lid member 26 are drawn outwards. Subsequently, one of the feeder lines is connected to the capacitor 34 of the socket 22 in which the capacitor 34 is stored, and the other feeder line 36 is connected to the power source 37 as described above.

In consequence, the capacitor 34, which has heretofore been attached to a certain place in the showroom or the showcase separately from the socket, can be stored in the socket 22. The capacitor 34 connected to the illuminative lamp 14 via the feeder line 36 does not have to be separately disposed in the showcase 1. Therefore, a wiring line treatment of the feeder line 36 can be simplified. Moreover, the number of the components can be reduced, and an assembly operability can be improved.

The power supply contact pieces 35 are constituted of an elastic material. Both of the power supply contact pieces 35, 35 are formed so that, as shown in FIGS. 11 and 14, the pieces are bent toward the center of the connecting portion 29 and come close to each other, then the power supply contact piece 35 stored in a side part of the connecting portion 29, that is, a front part of the main body side socket member 23 is turned forwards (to the left in FIG. 11), and the power supply contact piece 35 stored on a rear side is turned rearwards (to the right in FIG. 11). Furthermore, both of the pieces protrude toward an inner wall of the connecting portion 29 so that the pieces come close to the inner wall.

Moreover, a lower surface of this connecting portion 29 is provided with an inserting portion 39 for inserting the terminals 14A for receiving the power of the illuminative lamp 14 from a lower end of the connecting portion in a state in which the partition wall 29A is interposed. Therefore, the terminals 14A inserted from the inserting portion 39 formed at the lower end of the connecting portion 29 can enter the connecting portion 29 to which the power supply contact pieces 35 are attached.

Furthermore, in front and rear surfaces of this connecting portion 29, cutouts 29B, 29B are formed at a predetermined height from the lower end as shown in FIG. 17, specifically, up to the height at which the turned-back end surfaces of the power supply contact pieces 35 stored in the connecting portion 29 come close to the inner wall of the connecting portion 29.

In addition, before and after this connecting portion 29 (on the left and right sides in FIG. 14), engagement claws (engagement portions) 40, 40 hanging and then protruding inwards at lower ends are formed integrally with the housing 25. Since the engagement claws 40, 40 are inserted so as to disengageably engage with engagement claws 41, 41 formed at the illuminative lamp side socket member 24 described later, a predetermined space is formed between each engagement claw 40 and the connecting portion 29.

On the other hand, at a front end of the main body side attachment surface 28 of the housing 25, an auxiliary engagement portion 31 is formed so as to disengageably engage with the attachment piece 50 of the lower surface of the shelf 8 or the end portion attaching piece 67. This auxiliary engagement portion 31 is inclined at an angle substantially equal to that of the attachment piece 50 or 67 as described above, and formed to open toward the attachment piece 50 or 67. Therefore, in a state in which the auxiliary engagement portion 31 engages with the attachment piece 50 or 67, movement of a lower surface of an upper end of the auxiliary engagement portion 31 in a vertical direction is regulated by a lower end of each attachment piece 50 or 67. In consequence, the auxiliary engagement portion 31 engages with the attachment piece 50 or 67.

It is to be noted that the auxiliary engagement portion 31 is not limited to the above constitution, and there is not any restriction as long as the auxiliary engagement portion 31 can be moved in a direction meeting the longitudinal direction of the illuminative lamp 14 to engage with an engagement portion such as each attachment piece 50 or 67 formed at the lower surface of the shelf 8, and the movement of the auxiliary engagement portion in the vertical direction is regulated by the engagement portion formed on a main body side, that is, the lower surface of the shelf 8.

Moreover, a wall 31A is formed at the surface of this auxiliary engagement portion 31 opposite to an illuminative lamp side. This wall 31A is formed in a direction crossing the movement direction of the auxiliary engagement portion 31 at right angles.

Figure 27:
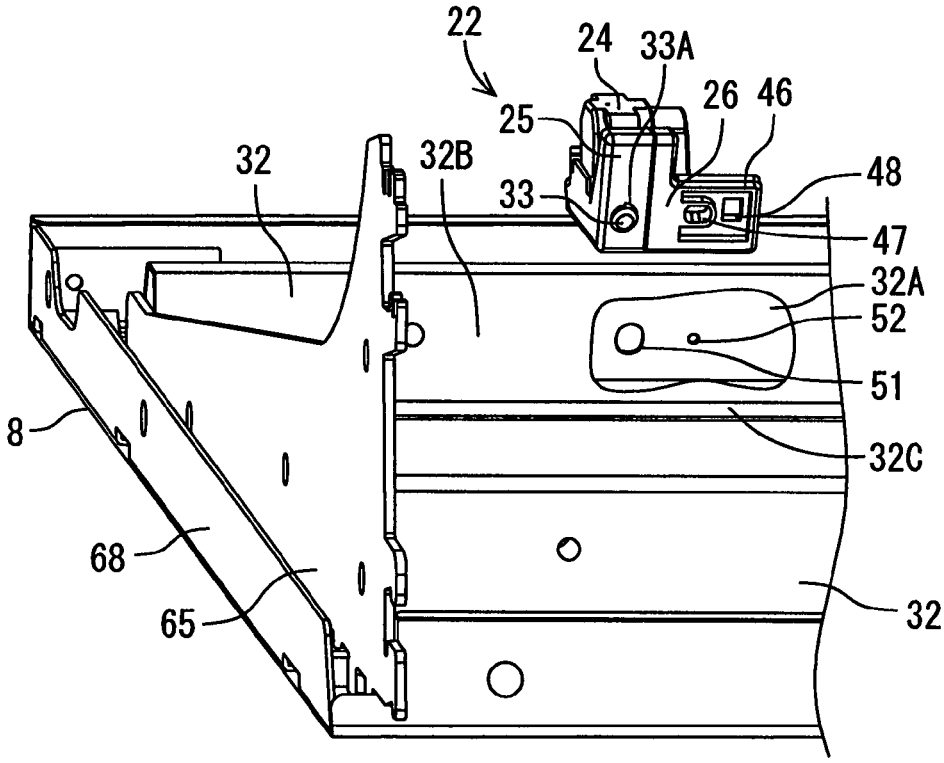
FIG. 27 is a partially cut perspective view showing that the socket is attached to the shelf lower surface as viewed from below.
Figure 28:
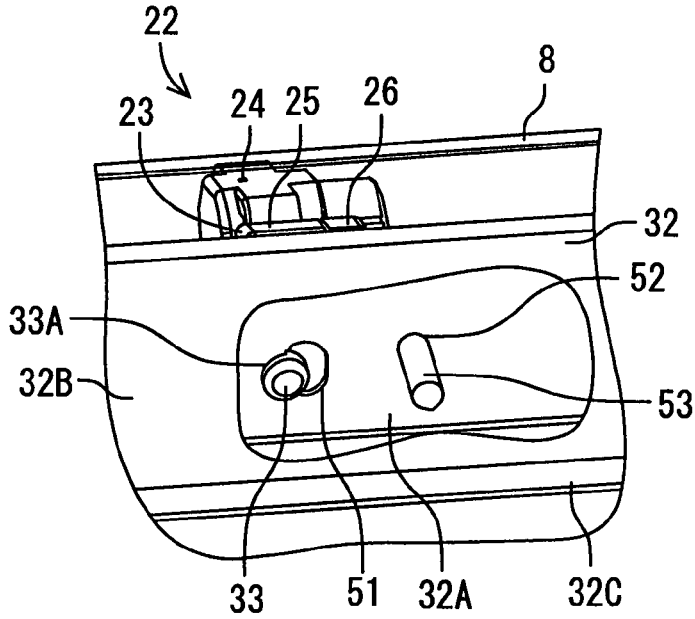
FIG. 28 is a partially enlarged view of FIG. 27.

Furthermore, the capacitor storage portion 30 of the housing 25 is inclined downwards and rearwards with respect to the main body side attachment surface 28. The rear surface of this capacitor storage portion 30 is inclined at a predetermined angle so that the portion can be attached along the front wall 32A of the reinforcement plate 32 formed at the lower surface of the shelf 8 and having a substantially trapezoidal sectional shape. As shown in FIGS. 27, 28, the reinforcement plate 32 is provided with an engagement hole 51 and a screw hole 52 in positions where the socket 22 is attached. On the other hand, the rear surface of the capacitor storage portion 30 is provided with a holding protrusion 33 (an engagement portion) which is formed so as to protrude toward the front wall 32A of the reinforcement plate 32. It is to be noted that the holding protrusion 33 is positioned on a side opposite to the auxiliary engagement portion 31 via the connecting portion 29.

It is to be noted that a cutout 33A (shown in FIGS. 27 and 28 only) having a predetermined dimension is formed substantially in the same plane as that of the rear surface of the capacitor storage portion 30 so as to be directed inwards. After the holding protrusion 33 is inserted into the engagement hole 51 formed in the reinforcement plate 32 via the cutout, the socket 22 is moved in a cutout direction, that is, a direction disengaging from the illuminative lamp 14 to engage the holding protrusion with the engagement hole 51 of the reinforcement plate 32 (FIG. 28). When the movement is performed, a screw hole 47 formed in the lid member 26 as described later is superimposed on the screw hole 52 formed in the reinforcement plate 32 to engage the holes with each other via a screw 53. In consequence, the socket 22 can securely be fixed to the reinforcement plate 32.

Moreover, the front surface of the capacitor storage portion 30 is an inclined surface 30A which is formed externally (on a rear side in the present embodiment) from the engagement claw 40 positioned on the rear side of the connecting portion 29 and which is continuously formed integrally with the claw. Moreover, when the engagement claw 40 engages with the engagement claw 41 of the illuminative lamp side socket member 24, the inclined surface disengages while inclining so as to form an acute angle. In consequence, a finger insertion space capable of passing fingers is formed between the inclined surface 30A and the engagement claw 41 of the illuminative lamp side socket member 24.

On the other hand, as shown in FIG. 15, the lid member 26 is formed so as to substantially constitute openings and outer shapes similar to those of the connecting portion 29 of the housing 25 and the capacitor storage portion 30. In a position corresponding to a lid portion of the connecting portion 29 of the housing 25, a cutout 42 for terminal insertion is formed which corresponds to the inserting portions 39 and the partition wall 29A formed in the housing 25. Furthermore, at an upper portion of the connecting portion 29, a flange 44 is formed which abuts on an upper edge of the illuminative lamp side socket member 24.

Moreover, the lid member 26 is provided with a feeder line drawing port 26A at a position corresponding to a rear portion of the main body side attachment surface 28 of the housing 25. Furthermore, at a position corresponding to a lid member of the capacitor storage portion 30, as shown in FIG. 12, a lid side capacitor storage portion 45 is formed so as to open toward the capacitor storage portion 30. In addition, a rear end of the lid side capacitor storage portion 45 is provided with a fixing portion 46 substantially having the same plane as that of the rear surface of the capacitor storage portion 30 of the housing 25. This fixing portion 46 is provided with the screw hole 47 and an earth terminal fixing portion 48 (shown in FIGS. 16 and 17) which abut on the reinforcement plate 32 attached to the lower surface of the shelf 8 as described above to engage with the screw hole 52 formed in the reinforcement plate 32.

Figure 25:
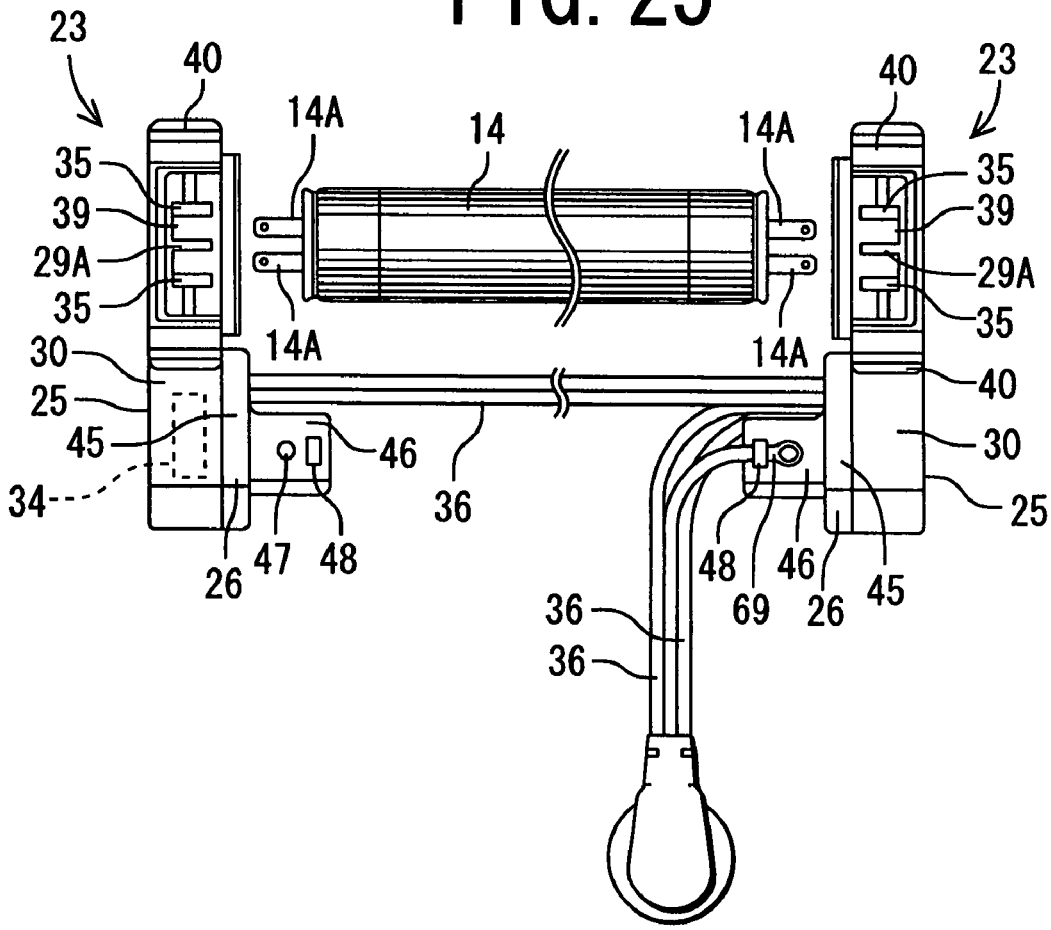
FIG. 25 is a schematic diagram showing that the feeder lines and the illuminative lamp are attached to the sockets.

Therefore, as described above, a terminal 69 for earth drawn from the power source 37 to the main body side socket member 23 together with the feeder lines 36 is stably fixed to the terminal fixing portion 48 for earth as shown in FIGS. 18 and 25. In consequence, the terminal 69 for earth can safely and easily be fixed to the main body side socket member 23, and a wiring line treatment of the terminal 69 for earth can be simplified.

Next, the illuminative lamp side socket member 24 will be described with reference to FIGS. 19 to 24. The illuminative lamp side socket member 24 is made of a hard synthetic resin in the same manner as in the main body side socket member 23, and constituted of an attachment portion 55 to be attached to an end portion of the illuminative lamp 14 and a storage portion 56 formed externally from the attachment portion 55.

The attachment portion 55 is constituted of the bottomed cylindrical cover portion 57 which surrounds the end portion of the illuminative lamp 14, and a plurality of illuminative lamp holding portions 58 formed so as to protrude inwards from an inner wall of the cover portion 57. The illuminative lamp holding portions 58 are capable of substantially tightly holding an outer periphery of the illuminative lamp 14 inserted into the cover portion 57. Since end portions of the illuminative lamp holding portions 58 on a showroom 5 side, that is, on an insertion side of the illuminative lamp 14 are formed so as to enlarge and open outwards, the end portion of the illuminative lamp 14 is easily inserted.

Moreover, as shown in FIGS. 21 and 24, an outer peripheral surface of this cover portion 57 is provided with thermal insulation cylinder holding portions 59 constituted of a plurality of protrusions substantially formed in parallel with the inserting direction of the illuminative lamp 14 (not shown in FIG. 23). A thermal insulation cylinder 43 is a transparent cylindrical member made of a hard synthetic resin, and surrounds a periphery of the illuminative lamp 14 along the longitudinal direction. The cylinder has a function of thermally separating the illuminative lamp 14 and the showroom 5 from each other, prevents the commodities in the showroom 5 from being adversely affected by heat of the illuminative lamp 14, and further prevents the illuminative lamp 14 itself from being cooled by cool air in the showroom 5 to prevent a drop of illuminance. For this purpose, an outer dimension of the cover portion 57 of the attachment portion 55 is formed to be smaller than an inner diameter dimension of the thermal insulation cylinder 43. Since a difference between the outer dimension of the cover portion 57 and the inner diameter dimension of the thermal insulation cylinder 43 is compensated by the protrusions of the thermal insulation cylinder holding portions 59, the thermal insulation cylinder 43 can substantially tightly be held.

Furthermore, a cylindrical bottom surface constituting the cover portion 57, that is, an outer end surface of the cover portion 57 is provided with terminal insertion holes 60, 60 capable of passing the terminals 14A, 14A for receiving the power which are arranged at the end portion of the illuminative lamp 14. Each terminal insertion hole 60 is formed into an elongated hole by caulking the center of the hole in an only one direction so that a length of the hole along the direction is smaller than that along another direction. Therefore, in a state in which the terminals 14A are inserted, inner edges of the terminal insertion holes 60 are brought into contact under pressure with the terminals 14A. In consequence, the terminals 14A once inserted into the terminal insertion holes 60 do not easily come off.

On the other hand, an upper surface of the storage portion 56 formed externally from the attachment portion 55 opens, and a storage space for detachably storing the connecting portion 29 of the main body side socket member 23 is formed in the storage portion. The terminals 14A of the illuminative lamp 14 inserted via the terminal insertion holes 60 of the cover portion 57 are allowed to enter the storage space, that is, the storage portion 56.

Moreover, at a lower corner of the storage portion 56, pressing portions 61, 61 formed so as to protrude inwards and upwards are formed integrally with the storage portion 56, respectively. Furthermore, a lower surface of the storage portion 56 is provided with a plurality of drain holes, that is, two drain holes 62, 62 in the present embodiment.

Before and after the storage portion 56 (shown on the left and right sides in FIG. 22), the engagement claws 41, 41 are formed integrally with the storage portion 56 so that the claws extend outwards, that is, in front and rear directions as much as predetermined dimensions from the lower surface of the storage portion 56, and are then raised substantially at right angles. The engagement claws 41, 41 are constituted of an elastic material which can be pressed inwards centering on a lower end. The engagement claw 41 having an upper end formed outwards, that is, on a front side is formed so as to protrude forwards, whereas the engagement claw 41 formed on a rear side protrudes rearwards. The engagement claws 41, 41 disengageably engage with the engagement claws 40, 40 formed at the main body side socket member 23, respectively, as described above.

Figure 29:
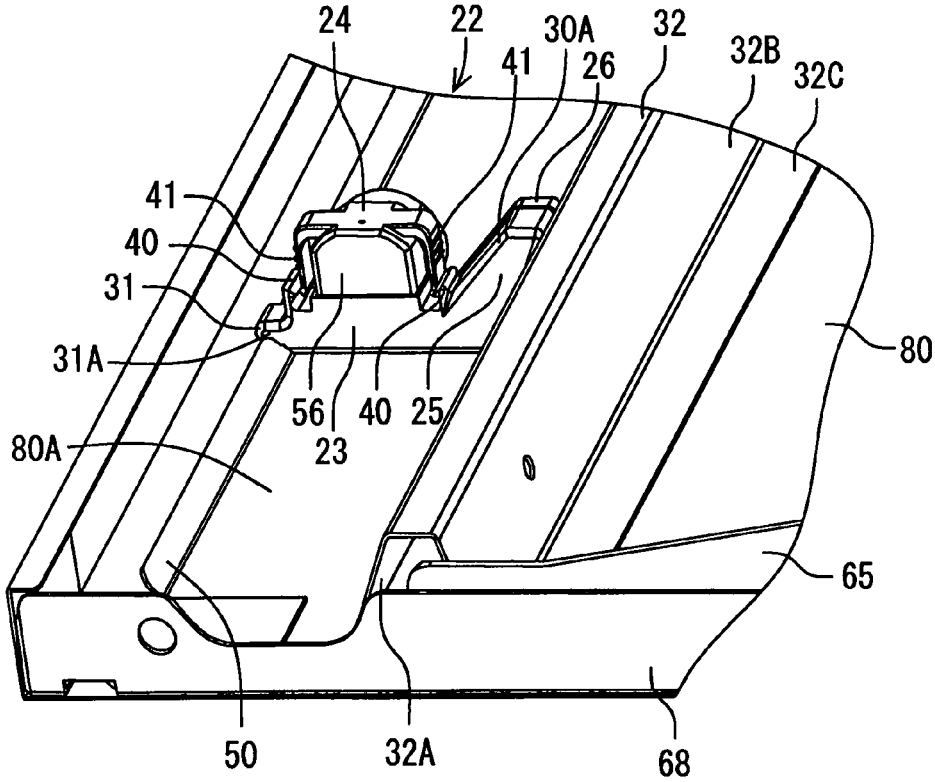
FIG. 29 is an enlarged perspective view showing that the socket is attached to the shelf lower surface as viewed from below.
Figure 30:
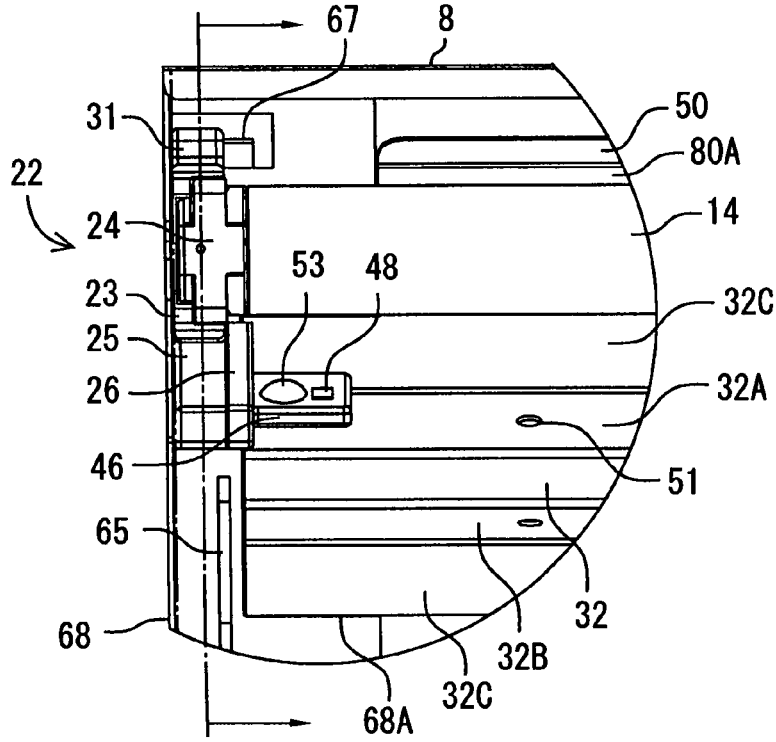
FIG. 30 is a partially enlarged plan view of the shelf lower surface.
Figure 31:
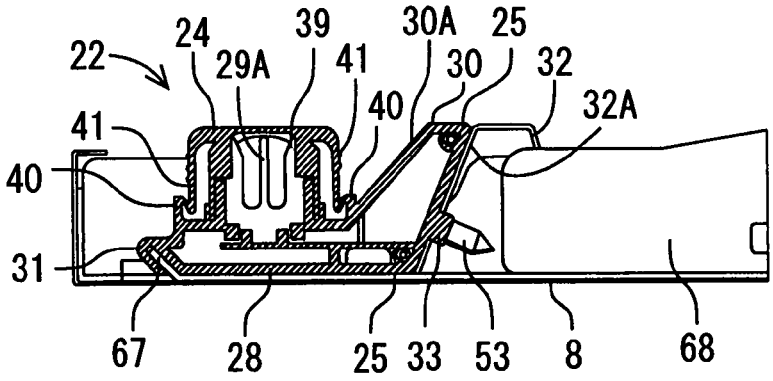
FIG. 31 is a partially vertical side view of FIG. 30.
Figure 32:
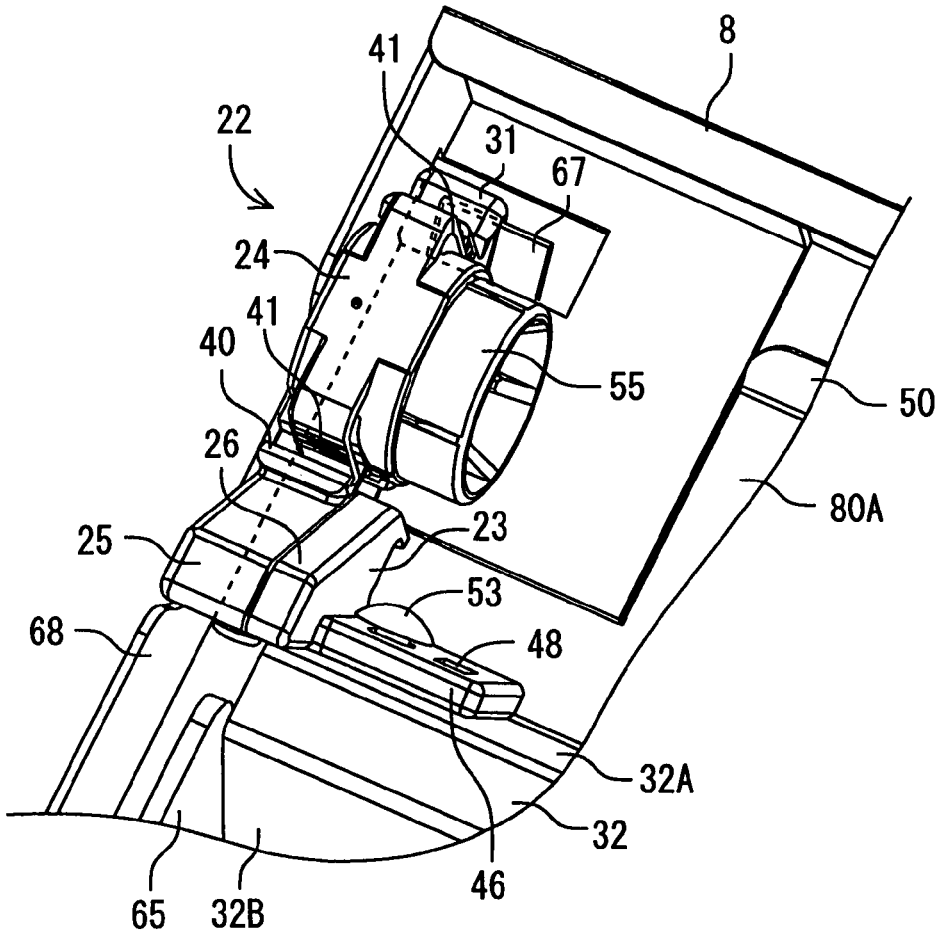
FIG. 32 is a partially enlarged perspective view of FIG. 30.
Figure 33:
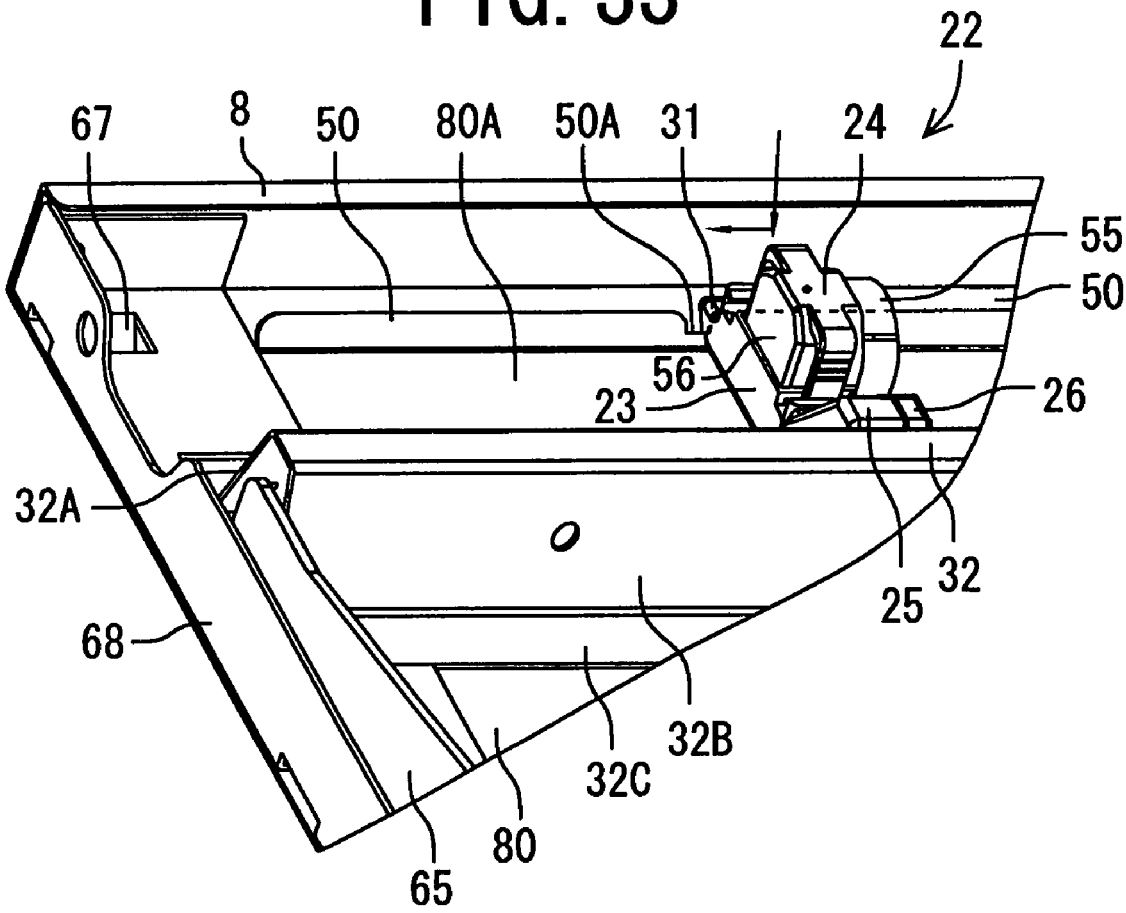
FIG. 33 is a partially enlarged perspective view showing an attached state of the socket.

Next, an attaching method of the sockets 22 and an attaching method of illuminative lamp 14 by use of the sockets 22 in the present embodiment will be described with reference to FIGS. 25 to 33. FIG. 25 is a schematic diagram showing that the feeder lines 36 and the illuminative lamp 14 are attached to the sockets 22; FIG. 26 is an electric wiring line diagram; FIG. 27 is a partially cut perspective view showing that the socket 22 is attached to the lower surface of the shelf 8 as viewed from below; FIG. 28 is a partially enlarged view of FIG. 27; FIG. 29 is an enlarged perspective view showing that the socket 22 is attached to the lower surface of the shelf 8 as viewed from below; FIG. 30 is a partially enlarged plan view showing that the socket 22 is attached to the lower surface of the shelf 8; FIG. 31 is a partially vertical side view of FIG. 30; FIG. 32 is a partially enlarged perspective view of FIG. 30; and FIG. 33 is a partially enlarged perspective view showing an attached state of the socket 22.

First, the main body side socket member 23 constituting the socket 22 is fixed to the lower surface of the shelf 8. As shown in FIGS. 8, 30 and 32, to attach the main body side socket member 23 to an end portion of the lower surface of the shelf 8, the auxiliary engagement portion 31 of the main body side socket member 23 is engaged with the end portion attaching piece 67. At this time, the auxiliary engagement portion 31 is engaged so that the wall 31A formed at the auxiliary engagement portion 31 surrounds an end surface of the end portion attaching piece 67 on a side opposite to the illuminative lamp 14. Moreover, the holding protrusion 33 formed at the rear surface of the capacitor storage portion 30 of the main body side socket member 23 is inserted along the shelf side plate 68 between the reinforcement plate 32 disposed on the lower surface of the shelf 8 and the shelf side plate 68 constituting a shelf side surface, and the auxiliary engagement portion 31 is engaged with the end portion attaching piece 67. Moreover, the screw hole 47 formed in the fixing portion 46 of the main body side socket member 23 is superimposed on a screw hole formed beforehand in the front wall 32A of the reinforcement plate 32 to engage the holes with each other via the screw 53.

In consequence, in a case where the main body side socket member 23 is constituted of two components, that is, the housing 25 and lid member 26, the holding protrusion 33 of the housing 25 is inserted between the front wall 32A of the reinforcement plate 32 and the shelf side plate 68. Moreover, the housing 25 is held, by the screw 53, between the lid member 26 directly fixed to the lower surface of the shelf 8 and the shelf side plate 68. Therefore, in a state in which the housing 25 abuts on the shelf side plate 68, the lid member 26 is fixed to the front wall 32A of the reinforcement plate 32 on the main body side by the screw 53 as a fixing member in a position where the housing 25 is prohibited from being moved inwards. Therefore, even when a downward pulling force is applied to the engagement claws 40, 40 formed at the housing 25, it is possible to avoid disadvantages that the lid member 26 is separated from the housing 25 and that the illuminative lamp 14 attached to the sockets 22 falls.

Especially, the fixing of the holding protrusion 33 to the reinforcement plate 32 and the fixing of the lid member 26 to the reinforcement plate 32 by the screw 53 are not performed in a disengaging direction with respect to a removing direction of the illuminative lamp 14. Therefore, during a replacement operation of the illuminative lamp 14, the sockets 22 are not easily removed. The sockets 22 can more stably be attached to the main body, that is, the lower surface of the shelf 8.

Moreover, the housing 25 is provided with the auxiliary engagement portion 31 positioned on the side opposite to the holding protrusion 33 via the connecting portion 29. The auxiliary engagement portion 31 is moved in the direction meeting the longitudinal direction of the illuminative lamp 14 to engage with the end portion attaching piece 67 disposed at the lower surface of the shelf 8. Therefore, the housing 25 constituting the socket 22 can be engaged with the lower surface of the shelf 8 by the holding protrusion 33 and the auxiliary engagement portion 31 between which the connecting portion 29 is sandwiched. The attaching strength of the housing 25 constituting the main body side socket member 23 can be improved.

Therefore, when the replacement operation of the illuminative lamp 14 is performed, the force is applied in such a direction as to disengage the illuminative lamp 14 from the lower surface of the shelf 8, that is, in a downward direction in the present embodiment. In consequence, even in a case where the force is applied to the socket 22 itself in such a direction as to disengage the socket from the lower surface of the shelf 8, since the socket is engaged with the lower surface of the shelf 8 by the holding protrusion 33 and the auxiliary engagement portion 31 formed at the housing 25 as described above, it is possible to avoid a disadvantage that the socket 22 itself disengages from the lower surface of the shelf 8.

Moreover, the engagement of the auxiliary engagement portion 31 with the end portion attaching piece 67 is not performed in the disengaging direction with respect to the removing direction of the illuminative lamp 14, because the movement of the lower surface of the upper end of the auxiliary engagement portion 31 in the vertical direction is regulated by the lower end of the end portion attaching piece 67. Therefore, during the replacement operation of the illuminative lamp 14, a disadvantage that the auxiliary engagement portion 31 disengages does not occur. Since the engagement with the holding protrusion 33 is also performed, the socket 22 is stably engaged with the lower surface of the shelf 8, and the socket 22 is not easily disengaged. The sockets 22 can more stably be attached to the main body, that is, the lower surface of the shelf 8. In consequence, the replacement operation of the illuminative lamp 14 can stably be performed.

Furthermore, in the present embodiment, the auxiliary engagement portion 31 has the wall 31A having the direction crossing the movement direction at right angles on the surface on the side opposite to the illuminative lamp 14. Therefore, the auxiliary engagement portion abuts on the shelf side plate 68 externally in the longitudinal direction of the illuminative lamp 14, that is, externally from the socket 22 as in the present embodiment. In consequence, it is possible to inhibit a disadvantage that the socket 22 itself falls or that an attachment position deviates. Such a disadvantage that makes unstable the attaching of the main body side socket member 23 itself can be inhibited.

Therefore, the wall 31A formed at the auxiliary engagement portion 31 abuts on the wall surface positioned externally from the socket 22, that is, the inner wall of the shelf side plate 68 in this case. In consequence, it is possible to undergo an urging force in the longitudinal direction of the illuminative lamp 14, and the attaching strength of the socket 22 can further be improved.

Moreover, when a rated length dimension of the illuminative lamp 14 is shorter than a width dimension of the showcase 1, the sockets are attached to the showcase 1 in accordance with the length dimension of the illuminative lamp 14. Therefore, the sockets 22 to which the illuminative lamp 14 is attached are not positioned at the end portions of the shelf 8, and can be positioned and attached internally from the end portions.

In this case, as shown in FIGS. 27, 29 and 33, the auxiliary engagement portion 31 of the main body side socket member 23 is engaged with the attachment piece 50. At this time, when the wall 31A formed at the auxiliary engagement portion 31 is inserted into the cutout 50A formed in the attachment piece 50, the wall 31A does not constitute any obstruction in engaging the auxiliary engagement portion 31 with the attachment piece 50. Moreover, the holding protrusion 33 formed at the rear surface of the capacitor storage portion 30 of the main body side socket member 23 is inserted into the engagement hole 51 formed beforehand in the reinforcement plate 32. Subsequently, while the holding protrusion 33 is inserted into the engagement hole 51, the main body side socket member 23 is directed outwards, that is, moved in such a direction as to disengage from the illuminative lamp 14 to engage the cutout 33A formed in the holding protrusion 33 with the end surface of the engagement hole 51. In this state, the screw hole 47 formed in the fixing portion 46 of the main body side socket member 23 is superimposed on the screw hole 52 formed beforehand in the reinforcement plate 32, and engaged by the screw 53.

It is to be noted that in this case, the auxiliary engagement portion 31 engaged with the attachment piece 50 by inserting beforehand the wall 31A into the cutout 50A has a width dimension which is larger than that of the cutout 50A. Therefore, even when the auxiliary engagement portion 31 is moved in the direction disengaging from the illuminative lamp 14, the auxiliary engagement portion remains to be engaged with the attachment piece 50. When the auxiliary engagement portion 31 is moved in this manner, the wall 31A formed at the portion abuts on an outer portion formed by the cutout 50A, that is, an end surface of the attachment piece 50 positioned on the side opposite to the illuminative lamp 14 (FIGS. 9 and 29).

In consequence, the auxiliary engagement portion 31 of the housing 25 is engaged with the attachment piece 50, and the wall 31A abuts on the end surface of the attachment piece 50. Moreover, the holding protrusion 33 is pressed onto the end surface of the engagement hole 51. In this state, the lid member 26 which blocks the opening of the housing 25 is directly fixed to the reinforcement plate 32 via screws.

Therefore, even in the case where the main body side socket member 23 is constituted of two components, that is, the housing 25 and the lid member 26, the holding protrusion 33 of the housing 25 is engaged with the engagement hole 51 of the reinforcement plate 32. Moreover, in the position where the housing 25 is prohibited from being moved inwards, the lid member 26 is fixed to the main body side, that is, the front wall 32A of the reinforcement plate 32 by the screw 53 as the fixing member. Therefore, even when the downward pulling force is applied to the engagement claws 40, 40 formed at the housing 25, it is possible to avoid the disadvantages that the lid member 26 is separated from the housing 25 and that the illuminative lamp 14 attached to the sockets 22 falls.

In the same manner as described above, the fixing of such a holding protrusion 33 to the reinforcement plate 32 and the fixing of the lid member 26 to the reinforcement plate 32 by the screw 53 are not performed in the disengaging direction with respect to the removing direction of the illuminative lamp 14. Therefore, during the replacement operation of the illuminative lamp 14, the sockets 22 are not easily removed. The sockets 22 can more stably be attached to the main body, that is, the lower surface of the shelf 8.

Moreover, the housing 25 is provided with the auxiliary engagement portion 31 positioned on the side opposite to the holding protrusion 33 via the connecting portion 29. The auxiliary engagement portion 31 is moved in the direction meeting the longitudinal direction of the illuminative lamp 14 to engage with the attachment piece 50 disposed at the lower surface of the shelf 8. Therefore, the housing 25 constituting the socket 22 can be engaged with the lower surface of the shelf 8 by the holding protrusion 33 and the auxiliary engagement portion 31 between which the connecting portion 29 is sandwiched. The attaching strength of the housing 25 constituting the main body side socket member 23 can be improved.

Therefore, when the replacement operation of the illuminative lamp 14 is performed, the force is applied in the direction to disengage the illuminative lamp 14 from the lower surface of the shelf 8, that is, in the downward direction in the present embodiment. In consequence, even in the case where the force is applied to the socket 22 itself in the direction to disengage the socket from the lower surface of the shelf 8, since the socket is engaged with the lower surface of the shelf 8 by the holding protrusion 33 and the auxiliary engagement portion 31 formed at the housing 25 as described above, it is possible to avoid the disadvantage that the socket 22 itself disengages from the lower surface of the shelf 8.

Moreover, the engagement of the auxiliary engagement portion 31 with the end portion attaching piece 67 is not performed in the disengaging direction with respect to the removing direction of the illuminative lamp 14, because the movement of the lower surface of the upper end of the auxiliary engagement portion 31 in the vertical direction is regulated by the lower end of the end portion attaching piece 67. Therefore, during the replacement operation of the illuminative lamp 14, the disadvantage that the auxiliary engagement portion 31 disengages does not occur. Since the engagement with the holding protrusion 33 is also performed, the socket 22 is stably engaged with the lower surface of the shelf 8, and the socket is not easily disengaged. The sockets 22 can more stably be attached to the main body, that is, the lower surface of the shelf 8. In consequence, the replacement operation of the illuminative lamp 14 can stably be performed.

Even in this case, in the present embodiment, the auxiliary engagement portion 31 has the wall 31A having the direction crossing the movement direction at right angles on the surface on the side opposite to the illuminative lamp 14. Therefore, the portion abuts on the end surface of the attachment piece 50 formed by the cutout 50A externally in the longitudinal direction of the illuminative lamp 14. In consequence, it is possible to inhibit the disadvantage that the socket 22 itself falls or that the attachment position deviates.

Therefore, the wall 31A formed at the auxiliary engagement portion 31 abuts on the wall surface positioned externally from the socket 22, that is, the end surface of the attachment piece 50 positioned externally from a cutout portion in this case. In consequence, it is possible to undergo the urging force in the longitudinal direction of the illuminative lamp 14, and the attaching strength of the socket 22 can further be improved.

Next, a method of attaching the illuminative lamp 14 and the illuminative lamp side socket member 24 to the main body side socket member 23 constituting the socket 22 will be described. First, the illuminative lamp side socket members 24 are attached to opposite ends of the illuminative lamp 14. At this time, the power receiving terminals 14A of the illuminative lamp 14 are passed through the terminal insertion holes 60, 60 formed in the cover portion 57. Moreover, the terminals 14A are opposed to the storage portion 56 formed externally from the cover portion 57.

Moreover, in the present embodiment, since the inner wall of the cover portion 57 is provided with the illuminative lamp holding portions 58, the illuminative lamp 14 is substantially tightly held in the cover portion 57. Furthermore, since the terminals 14A disposed at the illuminative lamp 14 are passed through the terminal insertion holes 60, the illuminative lamp is also substantially tightly held by the terminal insertion holes 60 having the caulked centers.

In consequence, in a state in which the illuminative lamp side socket members 24 are attached to the end portions of the illuminative lamp 14, the illuminative lamp 14 is held by the illuminative lamp side socket members 24. It is therefore possible to inhibit a disadvantage that the illuminative lamp side socket members 24 easily disengage from the illuminative lamp 14 during the attaching operation.

It is to be noted that in a state in which one illuminative lamp side socket member 24 is attached, the thermal insulation cylinder 43 may be attached to the illuminative lamp 14. In this case, the end portion of the thermal insulation cylinder 43 is substantially tightly held by the thermal insulation cylinder holding portions 59 formed at the outer peripheral surface of the cover portion 57 of the illuminative lamp side socket member 24. Therefore, it is possible to inhibit a disadvantage that the thermal insulation cylinder 43 falls during the replacement operation of the illuminatives lamp 14. The thermal insulation cylinder 43 can easily be attached to the illuminative lamp side socket member 24 together with the illuminative lamp 14.

In a state in which the illuminative lamp side socket members 24 are attached to the opposite ends of the illuminative lamp 14, the illuminative lamp side socket members 24 are attached to the main body side socket members 23. That is, the connecting portion 29 of the main body side socket member 23 is inserted to the storage portion 56 of the illuminative lamp side socket member 24. At this time, since the power receiving terminals 14A of the illuminative lamp 14 are opposed to the storage portion 56, the terminals 14A enter the storage portion from the inserting portion 39 formed at the lower end of the connecting portion 29 to come into contact with the power supply contact pieces 35 stored in the connecting portion 29.

Here, as described above, the power supply contact pieces 35 are formed of the elastic members, and bent toward the center of the connecting portion 29. After both of the power supply contact pieces 35 come close to each other, the pieces are turned sideways in the connecting portion 29. Therefore, the terminals 14A inserted from the inserting portion 39 are urged by elastic forces of the power supply contact pieces 35. In consequence, these terminals 14A are electrically connected to the power supply contact pieces 35.

Especially, in the storage portion 56 of the illuminative lamp side socket member 24 in the present embodiment, the pressing portions 61, 61 are formed at the lower corner. The pressing portions 61, 61 enter the connecting portion 29 from the cutouts 29B formed in the front and rear surfaces of the connecting portion 29. In consequence, the pressing portions 61 come into contact with the power supply contact pieces 35, 35 in the connecting portion 29, and then urges the power supply contact pieces 35 inwards, that is, toward the terminals 14A.

In consequence, the power supply contact pieces 35, 35 are deformed from a state shown by a dot line to a state shown by a solid line in FIG. 6, and the power supply contact pieces 35 can securely be brought into contact with the terminals 14A. Therefore, as compared with a conventional structure, the power supply contact pieces 35 can stably and securely be connected electrically to the terminals 14A of the illuminative lamp 14, and reliability can be improved.

Therefore, even when the force is applied to the terminals 14A of the illuminative lamp 14 attached to the shelf 8 via the sockets 22 in the disengaging direction from the power supply contact pieces 35 stored in the connecting portion 29 of the main body side socket member 23 owing to a weight of the illuminative lamp 14, the pressing portions 61 formed at the storage portion 56 of the illuminative lamp side socket member 24 can firmly press the power supply contact pieces 35 attached to the main body side socket member 23 onto the terminals 14A of the illuminative lamp 14. It is possible to avoid beforehand incomplete lighting due to contact defect and burnout of the terminals 14A or the sockets 22 due to an abnormal temperature rise, and reliability of the socket 22 itself improves.

Moreover, when the connecting portion 29 of the main body side socket member 23 is inserted into the storage portion 56 of the illuminative lamp side socket member 24 to further press upward the illuminative lamp side socket member 24, the engagement claws 41, 41 formed externally from the storage portion 56 engage with the engagement claws 40, 40 formed externally from the connecting portion 29 of the main body side socket member 23.

In consequence, the illuminative lamp side socket member 24 can stably be attached to the main body side socket member 23. Therefore, as compared with a conventional constitution in which the illuminative lamp is held by clips, the illuminative lamp 14 can easily be attached to the lower surface of the shelf 8, and the attaching operation can be simplified. Since the illuminative lamp side socket member 24 is stably engaged with the main body side socket member 23, the terminals 14A of the illuminative lamp 14 can stably be brought into contact with the power supply contact pieces 35 stored in the main body side socket member 23, and illumination can stably and safely be performed.

It is to be noted that in this case, since the illuminative lamp 14 is attached to the sockets 22, urging forces act on the sockets 22 in the longitudinal direction of the illuminative lamp 14. This direction is a direction in which the holding protrusion 33 formed at the main body side socket member 23 engages with the engagement hole 51 formed in the reinforcement plate 32. Therefore, the direction is a direction in which the blocking of the housing 25 of the main body side socket member 23 by the lid member 26 is maintained. Therefore, the engagement of the housing 25, the fixing of the lid member 26 and the maintaining of the bonding between the housing 25 and the lid member 26 are satisfactorily performed. In consequence, the sockets 22 can further stably be attached to the lower surface of the shelf 8.

In the above case, the socket 22 is fixed to the front wall 32A and the attachment piece 50 of the reinforcement plate 32 constituted on the lower surface of the shelf 8 and the lower surface of the shelf 8 positioned between the front wall and the attachment piece. The front wall 32A of the reinforcement plate 32 constitutes a rear reflective plate of the illuminative lamp 14, the attachment piece 50 constitutes a front reflective plate of the illuminative lamp 14, and the lower surface of the shelf 8 positioned between the front wall and the attachment piece constitutes a top reflective plate 80A of the illuminative lamp 14. Therefore, the socket 22 is attached to a series of these reflective plates. In consequence, since the socket 22 can stably be attached to the members having functions of the reflective plates of the illuminative lamp 14, the structure is more advantageous than a conventional socket attaching structure.

Moreover, the illuminative lamp 14 for use in the present embodiment is a so-called T5 tube of a fine tube type in which a distance between the terminals is about 5 mm as described above. Therefore, the illuminative lamp 14 itself can be formed to be thin as viewed from the front as compared with a conventional illuminative lamp. Therefore, it is possible to obtain a larger distance between the illuminative lamp 14 and the reflective plate formed behind the illuminative lamp 14, that is, the reinforcement plate 32 having a reflecting function in the present embodiment as compared with a conventional example. In consequence, a front portion of the showroom 5 or a portion before the showroom can effectively be illuminated with light of the illuminative lamp 14 reflected by the front wall 32A of the reinforcement plate 32 without being obstructed by the illuminative lamp 14 itself, and an illuminating effect can be improved.

Similarly, since the illuminative lamp 14 itself is constituted as a finer tube as compared with a conventional lamp, the attachment piece 50 positioned before the illuminative lamp 14 and the lower surface of the shelf 8 positioned between the attachment piece 50 and the reinforcement plate 32 can also efficiently function as the reflective plates. In consequence, it is possible to effectively irradiate the inside of the showroom 5, especially the commodities on the shelf 8 under the corresponding shelf 8, the commodities displayed at a distal end of the shelf 8 and the like with the light of the illuminative lamp 14 reflected by the attachment piece 50 and the lower surface of the shelf 8, and a display effect can be improved.

It is to be noted that the reinforcement plate 32 is disposed at not only a front portion but also a rear portion of the lower surface of the shelf 8 in the present embodiment. Therefore, the illuminative lamp 14 can be positioned before and after the lower surface of the shelf 8 when attached. In consequence, the inside of the showroom 5, especially an area on the shelf 8 disposed under the corresponding shelf 8 can more effectively be illuminated.

Moreover, in the present embodiment, since the illuminative lamp 14 of the fine tube type can detachably be attached to the lower surface of the shelf 8 by the sockets 22 as described above. The lower end of the illuminative lamp 14 can substantially be the same plane as that of the lower end of the shelf 8 as shown in FIG. 31. Therefore, when the shelf 8 is viewed from the front, the illuminative lamp 14 does not have to protrude downwards, and the shelf 8 itself can be constituted to be thinner. In consequence, each shelf 8 is constituted to be slim, and the whole showcase is aesthetically improved.

It is to be noted that to release the engagement between the main body side socket member 23 and the illuminative lamp side socket member 24, an index finger or a middle finger is inserted into the finger insertion space formed between the inclined surface 30A formed at the front surface of the capacitor storage portion 30 of the main body side socket member 23 and the rear engagement claw 41 formed at the illuminative lamp side socket member 24, and the front engagement claw 41 is touched with a thumb. Moreover, when the engagement claw 41 is manually pressed inwards, the engagement claw 41 is deformed inwards to release the engagement with the engagement claw 40.

At this time, for example, a first joint of the index finger or the middle finger inserted into the finger insertion space abuts on the inclined surface 30A to thereby apply a principle of a lever by use of the abutment portion as a shaft. In consequence, the engagement claw 41 can be pressed inwards with a smaller force to release the engagement. Therefore, a trouble in the engaging operation of the main body side socket member 23 with the illuminative lamp side socket member 24 can be eliminated, and the attaching operation of the illuminative lamp 14 can be simplified.

What is claimed is:

1. A showcase provided with an illuminative lamp having terminals at opposite end portions, respectively, the showcase comprising:

a pair of sockets which connect the illuminative lamp to a power source of a main body, each socket including a housing having an opening in at least a surface on an illuminative lamp side, and a lid member to block the opening of the housing in a state in which the terminals are allowed to enter the housing, the housing having a connecting portion storing a power supply portion being internally connected to the terminal, and an engagement portion moved in a direction disengaging from the illuminative lamp to engage with the main body, the lid member being fixed to the main body by a fixing member in a state in which the lid member blocks the opening of the housing which engagement portion is engaged with the main body.

2. The showcase according to claim 1, wherein the housing has an auxiliary engagement portion to engage with the main body in a position on a side opposite to the engagement portion via the connecting portion.

3. The showcase according to claim 2, wherein the auxiliary engagement portion is moved in a direction which meets a longitudinal direction of the illuminative lamp to engage with the main body, and has a wall in a direction crossing the movement direction at right angles on a surface on a side opposite to the illuminative lamp.

4. The showcase according to claim 2 or 3, wherein the socket is constituted of a main body side socket member including the housing and the lid member, and an illuminative lamp side socket member attached to the illuminative lamp and detachably attached to the main body side socket member;

the connecting portion of the housing has an inserting portion capable of passing the terminal in the surface crossing the opening at right angles; and the illuminative lamp side socket member is attached to the main body side socket member from a direction of the inserting portion so that the terminal passes through the inserting portion and is connected to the power supply portion.

* * * * *